US011844447B2

(12) United States Patent
Holmes

(10) Patent No.: US 11,844,447 B2
(45) Date of Patent: Dec. 19, 2023

(54) CUSTOMIZABLE FRAMING SYSTEM AND METHOD OF ASSEMBLING SAME

(71) Applicant: Quentin Holmes, Peterborough (CA)

(72) Inventor: Quentin Holmes, Peterborough (CA)

( * ) Notice: Subject to any disclaimer, the term of this patent is extended or adjusted under 35 U.S.C. 154(b) by 0 days.

(21) Appl. No.: 17/484,561

(22) Filed: Sep. 24, 2021

(65) Prior Publication Data

US 2022/0248878 A1 Aug. 11, 2022

Related U.S. Application Data

(63) Continuation-in-part of application No. 17/173,693, filed on Feb. 11, 2021, now abandoned.

(51) Int. Cl.
*A47G 1/08* (2006.01)
*A47G 1/06* (2006.01)

(52) U.S. Cl.
CPC ..... *A47G 1/08* (2013.01); *A47G 1/0627* (2013.01)

(58) Field of Classification Search
CPC ..... A47G 1/08; A47G 1/0627; A47G 1/10; A47G 1/142; A47G 1/1606; A47G 1/0616; B44C 5/02
See application file for complete search history.

(56) References Cited

U.S. PATENT DOCUMENTS

| | | | | |
|---|---|---|---|---|
| 996,915 | A | 7/1911 | Engelmohr | |
| 3,465,461 | A | 9/1969 | Price et al. | |
| 3,823,499 | A | 7/1974 | Gilbert | |
| 5,095,641 | A | 3/1992 | Dahl | |
| 5,187,886 | A * | 2/1993 | Wu | A47G 1/0605 248/497 |
| 5,265,358 | A * | 11/1993 | Borod | A47G 1/101 403/402 |
| 10,034,452 | B2 * | 7/2018 | Lowenthal | A01K 5/0225 |
| 2005/0178038 | A1 | 8/2005 | Kucharski | |
| 2008/0209787 | A1 | 9/2008 | Alcov | |
| 2009/0139127 | A1 * | 6/2009 | Southard | A47G 1/065 40/761 |

FOREIGN PATENT DOCUMENTS

| | | | |
|---|---|---|---|
| CA | 2148778 | A1 | 5/1995 |
| DE | 202006017361 | U1 | 5/2007 |
| KR | 200378921 | Y1 | 3/2005 |
| KR | 20180000987 | U | 4/2018 |

* cited by examiner

*Primary Examiner* — Cassandra Davis

(57) ABSTRACT

The invention relates to a customizable frame system, which can be customized for both shape and size. In some embodiments only the corners are visible, and the structural rails are hidden. In other embodiments, the rails create a frame around the outside of the picture. The rails, and in some embodiments the corners, have a notch that allows the frame to be hung from various sides. The framing system can be supplied in standard sizes and custom sizes. Each corner can be a different shape and color or theme. They can be decorated or embellished with materials, objects or characters. The sides, rails and corners form reusable pieces to make different sizes for new frames.

19 Claims, 34 Drawing Sheets

202
204

204
206

216
202
210
214

212

208

FIG. 12A
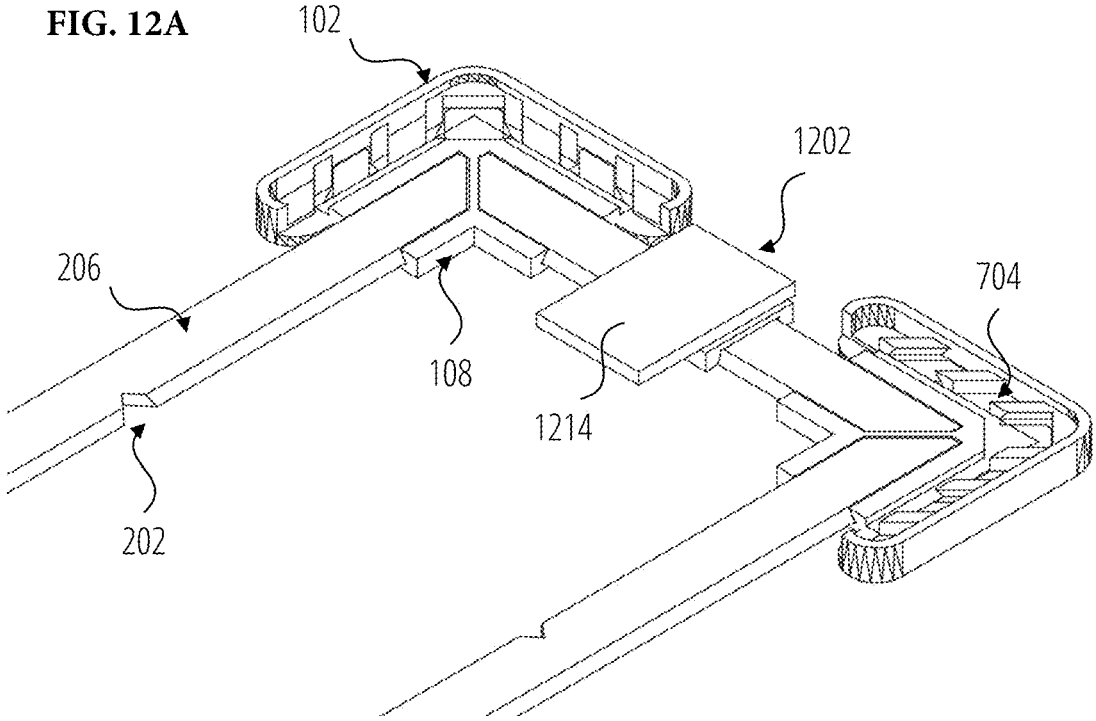
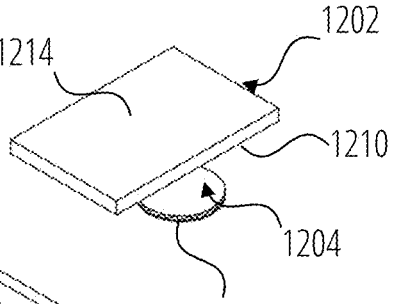
FIG. 12C
FIG. 12B
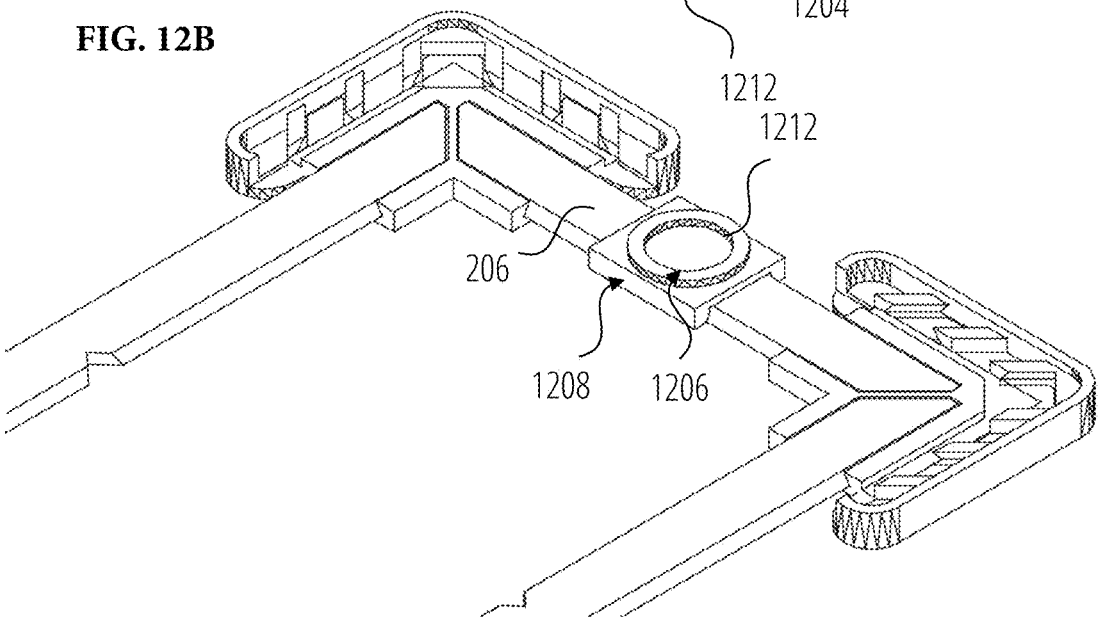

FIG. 13A
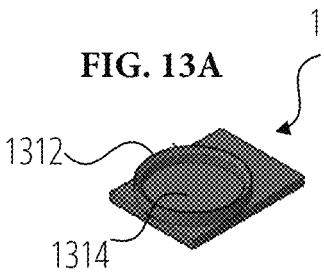
FIG. 13B
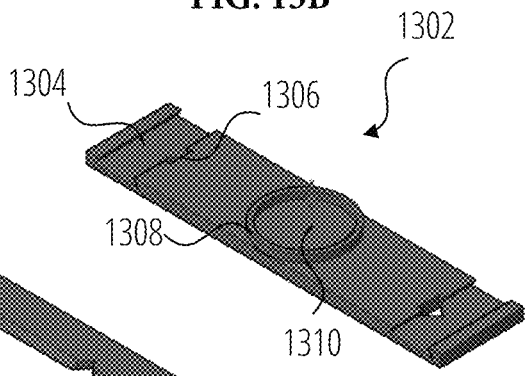
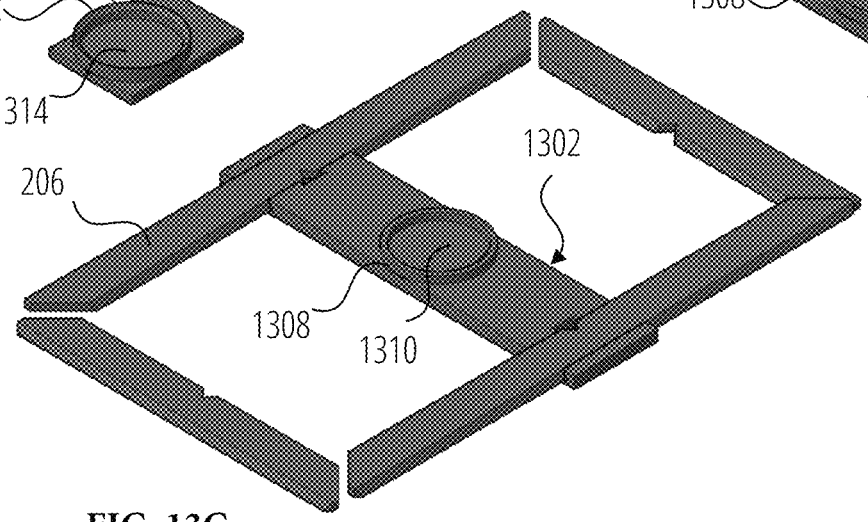
FIG. 13C

CUSTOMIZABLE FRAMING SYSTEM AND METHOD OF ASSEMBLING SAME

This application is a continuation-in-part and claims the benefit of U.S. patent application Ser. No. 17/173,693, filed Feb. 11, 2021 and is incorporated herein by reference in its entirety.

FIELD OF THE INVENTION

The present invention relates generally to the field of customizable framing system, specifically to a framing system having a combination of corners and rails, thereby giving the ability to create different shapes and sizes of frames for photos, collages and artwork.

BACKGROUND

US20050178038 discloses a framing device for two-dimensional (planar) and relief artwork that is functional and decorative, and can be used multiple times and in various ways for personal or professional exhibition purposes. The framing device is generally a wall support for planar and relief art and supporting materials, and is designed for any size artwork. Modular elements connect together and can be used in multiple combinations to provide a structure that supports an art package for display. An art package generally consisting of art and supporting materials generally rests between the corner unit lip and a back support structure. Corner units connect to each other or to extenders with adjoining hardware, and optional fasteners, dust masks, shims, risers, and support bars provide more adaptation choice. This support system frames artwork and makes it ready to hang for display. The framing system elements are variable, adaptable, and re-usable.

KR200378921 discloses a picture frame that is supplied in disassembled state can be cut and assembled to fit the size of a picture or picture, and corner brackets and supports To prevent the frame from being exposed, and if you want to replace it with a picture or photo with a new size during use, you can cut the support to reconstruct the frame with the new size.

CA2148778 discloses a picture frame assembly, and more particularly to an improved picture frame assembly having corner members and side frame members which are such secured together as to form a stronger frame assembly with traditional esthetic appearance. In addition, the side frame members of the picture frame assembly may be easily adjusted to form different size picture frames.

US3823499 discloses An adjustable frame comprising corner members, cross braces for connecting said corner members, the cross braces comprising strips which can be cut down or bent back so as to adjust the cross braces to any desired frame size, a plurality of apertures on each of the cross braces performing a double function, the first function being to provide apertures for connecting the brace to diagonally opposite corner member, the second function being to provide means for anchoring a suspension wire to the frame.

US3465461 discloses an adjustable frame for pictures, prints, paintings, on canvas, paper, plywood or any other sheet material, whether flexible or rigid. More particularly, the frame of the present invention is instantly adjustable to frame the reproduction without imparting any stress or strain thereto to cause damage to the painting. The present frame is adjustable within the range of its parts without the need for any tools or implements by the simple operation of merely sliding the frame parts together and, by hand, US5095641 discloses an expandable picture frame assembly includes an annular enclosure and a resiliently flexible spring. The enclosure has a front, a rear, and an interior surface bounding a picture-storing cavity defined between the front and rear of the enclosure. In one embodiment, the spring member is attached to the interior surface of the enclosure and projects partially across the cavity. The spring member is capable of being flexed toward and away from the front and rear of the enclosure for holding multiple pictures in a compact stacked arrangement behind one another with only a front one being displayed through a front opening of the enclosure.

DE202006017361 discloses a picture frame with four corner profiles and four longitudinal profiles, which are telescopically inserted into each other and by fasteners can be fixed in relation to one another in their relative position, characterized in that the fasteners Velcro strips.

KR20180000987 discloses a frame that can be resized, and includes two outer frames for adjusting the size of the frame. Two inner frames to adjust the size of the frame because the horizontal frame and the vertical frame are connected. The outer frame has a square shape having a length equal to the vertical length of the hole formed in the outer frame and connects the outer frame to the inner frame. The invention has the effect of allowing the user to adjust the size of a picture frame according to the size of a picture or a picture or the like so that the user can adjust the size of a picture or a picture of a desired size.

US996915 discloses adjustable picture frames. An important object of the present invention is to provide an extensible picture frame, which is neat in appearance, easy to adjust to alter its size and cheap to manufacture.

US20080209787 discloses an adjustable frame system, and more particularly to an adjustable photo frame system. The adjustable frame system comprises a front portion which may have detailing to provide a pleasant appearance. The back may contain a means of encompassing a photo, the backing, a sheet of glass or a digital photo frame. A method of allowing the portions to move apart to the desired size and then hold that size is provided.

All documents cited herein are incorporated by reference.

None of the above cited documents, alone or in combination, satisfy the need for a customizable framing system of corners and rails thereby giving the ability to create different sizes of frames with different corners and shapes.

BRIEF SUMMARY

It is an object of the invention to provide a customizable framing system.

In accordance with an aspect of the invention there is provided a kit for constructing an artwork frame, said kit comprising: a plurality of corner sections, each of the corner sections having one or more a finger joints; a plurality of corner support members, each of the corner support members having one or more finger joint grooves sized and proportioned to attach to the one or more finger joints, the corner support members further comprising two or more side rail channels; a plurality of side rails sized and proportioned for reciprocating insertion into the side rail channels; and a display member attached to, molded as part of, or formed in, one or more of the plurality of corner sections, or one or more of the plurality of side rails.

In accordance with an additional aspect of the invention there is provided a method of constructing the artwork frame as described above, said method comprising the steps: selecting shape and number of the corners sections, and corner support members appropriate to accommodate the item to be framed; attaching said corner supports members to said corner sections via said finger joints and finger joint grooves; selecting the number and size of side rails that fit into the space between each of said corner support members; sliding said side rails into said side rail channels; selecting the desired display member; inserting the artwork to be framed into the constructed frame; and optionally inserting a sheet of appropriately sized acrylic into the frame.

In accordance with an aspect of the invention there is provided an alternative kit for constructing an artwork frame, said kit comprising: a plurality of corner sections, each of said corner sections having one or more a first attachment members; a plurality of corner support members, each of said corner support members having one or more second attachment members sized and proportioned to attach to said one or more first attachment members, said corner support members further comprising two or more side rail channels; and a plurality of side rails sized and proportioned for reciprocating insertion into said side rail channels.

In accordance with another aspect of the invention there is provided an artwork frame, said frame comprising: a plurality of corner sections, each of said corner sections having one or more a first attachment members; a plurality of corner support members, attached to each of said corner support members via one or more second attachment members sized and proportioned to cooperated with said one or more first attachment members, said corner support members further comprising two or more side rail channels; and a plurality of side rails, connecting said plurality of corner support members, via insertion into said channels, wherein said plurality of corner sections and said plurality of side rails, define a perimeter that forms said frame.

In accordance with an additional aspect of the invention there is provided a method of constructing the artwork frame, said method comprising the steps: selecting the shape and number of said corners sections appropriate to accommodate the item to be framed; attaching said corner supports members to said corner sections via said first and second attachment members; selecting the number and size of side rails that fit into the space between each of said corner support members; sliding said side rails into said side rail channels; and optionally inserting a sheet of appropriately sized acrylic, such as Perspex™, into the frame.

In accordance with an additional aspect of the invention there is provided a kit for constructing an artwork frame, said kit comprising: a plurality of corner sections, each of the corner sections having one or more first attachment members; a plurality of corner support members, attached to each of the corner support sections via one or more second attachment members sized and proportioned to cooperate with the one or more first attachment members; a plurality of side rails, each connecting two corner support members; and two or more display members, one or more of said two or more display members comprises an essentially planar structure that extends horizontally or vertically away from the rear of the frame, and one or more of the two or more display members are independently selected from the group consisting of: a notch; a stand-off extender; a free-standing support a hanging member; and a metal disc or magnet, wherein the plurality of corner sections, and the plurality of corner support members, and the plurality of side rails, define a perimeter of the artwork frame.

In accordance with an additional aspect of the invention there is provided a kit for constructing an artwork frame, said kit comprising: a plurality of corner sections, each of the corner sections having one or more first attachment members; a plurality of corner support members, attached to each of the corner support sections via one or more second attachment members sized and proportioned to cooperate with the one or more first attachment members; a plurality of side rails, each connecting two corner support members; and two or more display members, one of said two or more display member is the a hanging member comprising a first lip that is sized and configured to engage with one of the plurality of side rails on a first frame and second lip that is sized and configured to engage with one of the plurality of side rails on a second frame, and one or more of the two or more display members independently selected from the group consisting of: a notch; a stand-off extender; a free-standing support and a metal disc or magnet, wherein the plurality of corner sections, and the plurality of corner support members, and the plurality of side rails, define a perimeter of the artwork frame.

The advantages and features of the present invention will become better understood with reference to the following more detailed description and claims taken in conjunction with the accompanying drawings in which like elements are identified with like symbols.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

FIGS. 12A, 12B and 12C illustrate rear perspective aspects of the subject matter in accordance with top mounting features of an embodiment of the invention.

FIGS. 13A, 13B and 13C illustrate rear perspective aspects of the subject matter in accordance with central mounting features of an embodiment of the invention.

DETAILED DESCRIPTION

Figure 1A:
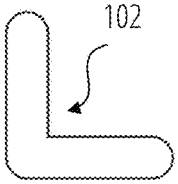
FIGS. 1A, 1B, 1C, 1D, 1E, 1F, 1G, 1H, 1I, 1J and 1K illustrate several aspects of the subject matter in accordance with the corner embodiments of the invention.
Figure 1B:
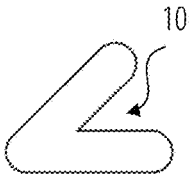
Figure 1C:
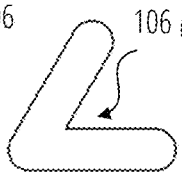
Figure 1D:
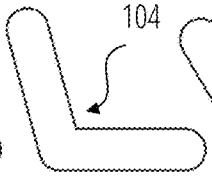
Figure 1E:
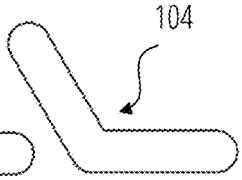

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The invention relates to a customizable frame system, which can be customized for both shape and size. In some embodiments only the corners are visible, and the structural rails are hidden. In other embodiments, the rails create a frame around the outside of the picture. The rails, and in some embodiments the corners, have a notch that allows the frame to be hung from various sides.

The framing system can be supplied in standard sizes and custom sizes. Each corner can be a different shape and color or theme. They can be decorated or embellished with materials, objects or characters. The sides, rails and corners form reusable pieces to make different sizes for new frames.

The frames are built from common components. In embodiments having both corners and side rails visible, the corners and the side pieces or rails can be different shapes and colors, and can be thick corners, thin corners, round, square, or themed. Plastic colors are almost unlimited and could also include stickers. Corners could also be mixed and matched.

The side rails are a very basic shape that create the size of the frame. They could be hidden or create a visible frame around the outside of the picture. Each rail has a notch that allows the frame to be hung from all sides. Thin plastic sheets could be put in front of the pictures to create the illusion of glass frames. The sheets could also be themed. Additional clip-or stick-on fun shapes could be added. People love picture walls but buying many frames is expensive. The frames are not flexible if you want to change your mind of what pictures are included. People could have holiday themed frames for pictures at different times of year.

The frames are light and can be hung using small removable Command™hanging strips, or magnets or by other means known to those of skill in the field. The individual components can be fabricated using standard injection molding techniques or they can be 3D printed. The frames can be sold as kits and individual pieces. In certain embodiments of the invention consumers could cut their own sizes and create their own shapes.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

FIGS. 1A, 1B, 1C, 1D and 1E show a variety of different corner sections of embodiments of the invention.

Figure 1F:
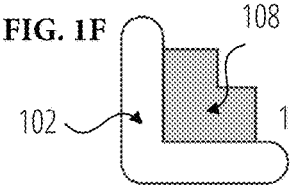

These sections include a (FIG. 1A) right angled corner section 102, (FIGS. 1B and 1C) different acute angled corner sections 106, and different (FIGS. 1E and 1F) obtuse angled corner sections 104.

Figure 1G:
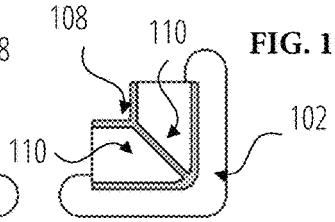

A corner support member 108, sized and proportioned to co-operate with a right-angled corner section 102 can be seen from the front in one of the illustrations (F), and from the rear in another illustration (FIG. 1G). In illustration (FIG. 1G), tracks can be seen on the reverse side of the corner support member 108 that accommodate side rail tracks 110.

Figure 1H:
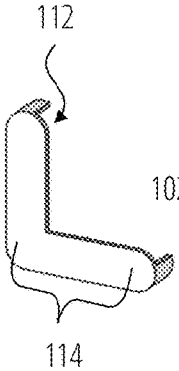
Figure 1I:
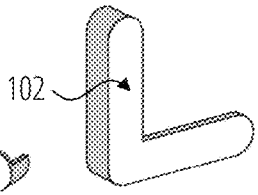
Figure 1J:
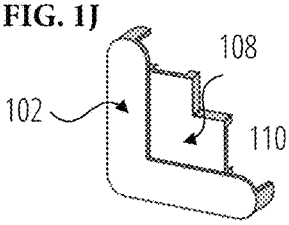
Figure 1K:
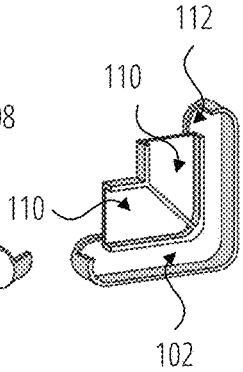
Figures 2A, 2B, 2C, 2D, 2E, 2F, 2G, 2H:
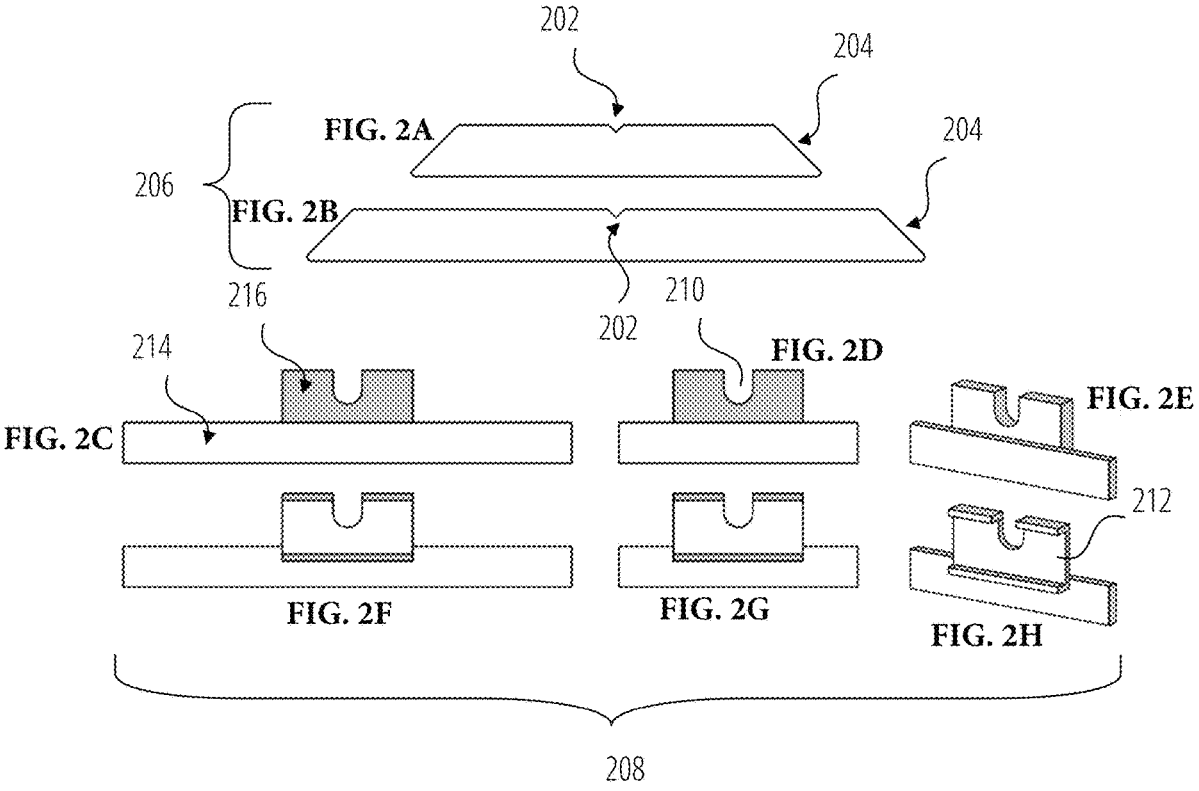
FIGS. 2A, 2B, 2C, 2D, 2E, 2F, 2G and 2H illustrate several aspects of the subject matter in accordance with the side or rail embodiments of the invention.
Figure 3A:
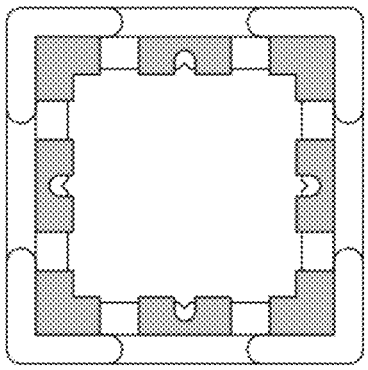
FIGS. 3A, 3B, 3C and 3D illustrate front and rear aspects of the subject matter in accordance with square and rectangular frame embodiments of the invention.
Figure 3B:
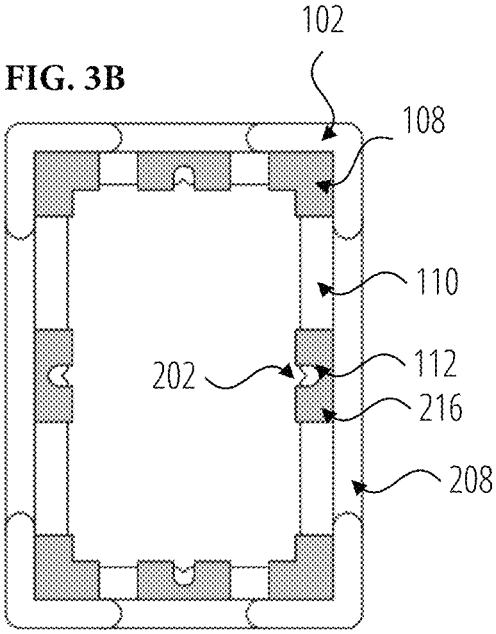
Figure 3C:
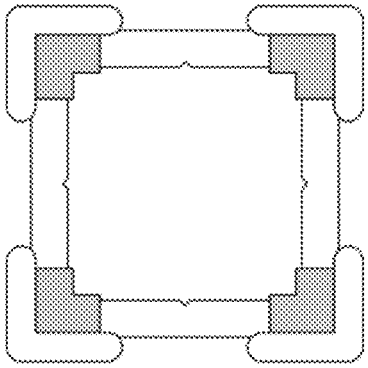
Figure 3D:
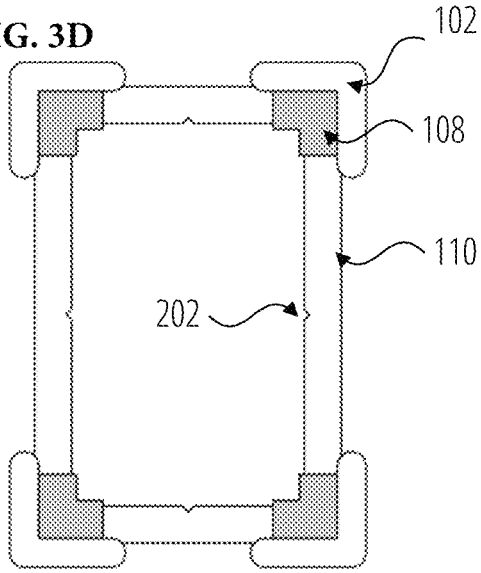

Other illustrations (FIGS. 1H, 1I, 1J and 1K) show perspective views of the right-angled corner sections 102. Illustrations (FIGS. 1H, 1I, and 1J) show front facing views, one of which shows the co-operating indent 112 on the right-angled corner section 102 that accommodates the corner support member 108. An additional illustration (FIG. 1K) the corner support member 108 can be seen from the reverse side, affixed to a right-angled corner section 102, side rail tracks 110 can be seen on the rear of the corner support member 108.

The embodiments as illustrated in FIG. 1 show two-piece corner sections, wherein a corner section 102 attached to a corner support member 108. It is contemplated to be within the scope of the alternative embodiments of the invention that the corner pieces may be a unitary structure.

FIGS. 2A, 2B, 2C, 2D, 2E, 2F, 2G and 2H shows a variety of side rails 206 and outer frame edges 208.

Illustrations (FIGS. 2A and 2B) show different length side rails 206. Each end of these side rails 206 have a central notch 202 and mitered ends 204. In one embodiment, the notches 202 allow the customized frame to be hung by providing a pivot point that cooperates with a hanging device such as a nail. The mitered ends 204 of the side rails 206 slide into the side rail track 110 on the corner support members 108. In one embodiment of the invention, the side rail 206 alone, in conjunction with the corner support members 108 affixed to the right-angled corner sections 102 form the customized frame.

Various other embodiments of the invention have rails that have alternatively shaped ends, that are possibly mitered at different angles, or not mitered at all.

In a further illustrated embodiments (FIGS. 2C, 2D, 2E, 2F, 2G and 2H) of the invention, outer frame edges 208 are additionally affixed to the side rail 206 so as to form a frame continuous with the right-angled corner sections 102. The frame edges 214 have central side rail clips 216 that engage with the side rail 206. Each side rail clip 216 has a co-operating notch 210 so as not to cover or obscure the notch 202. Illustrations (FIGS. 2C, 2D, and 2E) show the outer frame edge 208 from the front, and illustrations (FIGS. 2F, 2G, and 2H) show the outer frame edge 208 from the rear. Illustration 2H indicates in greater detail clip section 212 of the outer frame edge 208 that are sized to engage with the side rail 206.

FIGS. 3A, 3B, 3C, and 3D show front views of square (FIGS. 3A and 3C) rectangular (FIGS. 3B and 3D) customizable frames in accordance with embodiments of the invention. Illustrations (FIGS. 3A and 3B) show frames with continuous edges provided by right angled corner sections 102 and outer frame edge 208. Other illustrations (FIGS. 3C and 3D) show frames that appear to just have corner sections, and no visible edges when hung.

Figure 4A:
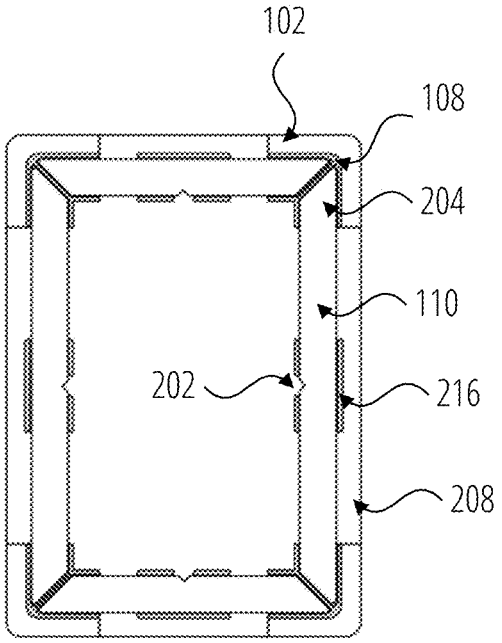
FIGS. 4A and 4B illustrate additional rear aspects of the subject matter in accordance with rectangular embodiments of the invention.
Figure 4B:
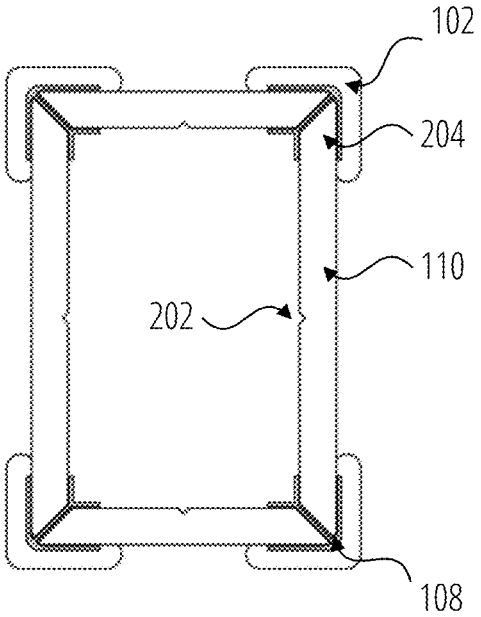

FIGS. 4A and 4B shows the rectangular embodiments of the invention illustrated in FIG. 3, but from the reverse side.

Figure 5A:
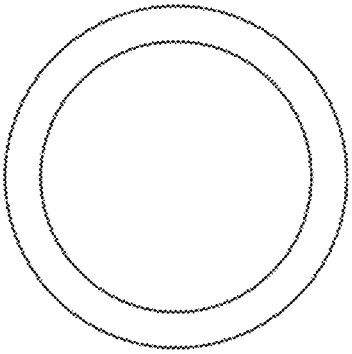
FIGS. 5A, 5B and 5C illustrate front aspects of the subject matter having various different geometric shapes of in accordance with embodiments of the invention.
Figure 5B:
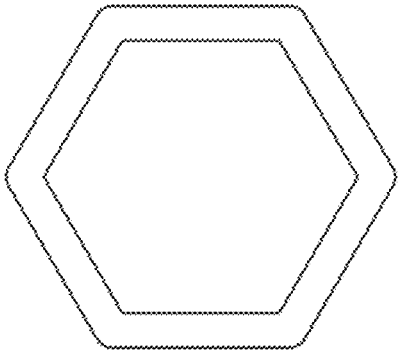
Figure 5C:
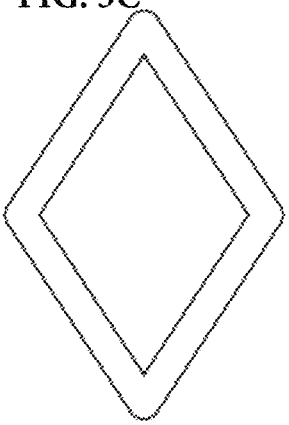

FIGS. 5A, 5B, and 5C shows different geometric shaped frames. Illustration FIG. 5A is constructed from numerous arced shaped corner sections. Illustration FIG. 5B is constructed from six obtuse angled corner sections 104 each having an interior angle of 120o and six side rails 206 and six outer frame edges 208. Illustration FIG. 5C is constructed from two obtuse angled corner sections 104, two acute angled corner sections 106 and four side rails 206 and four outer frame edges 208.

Figure 6A:
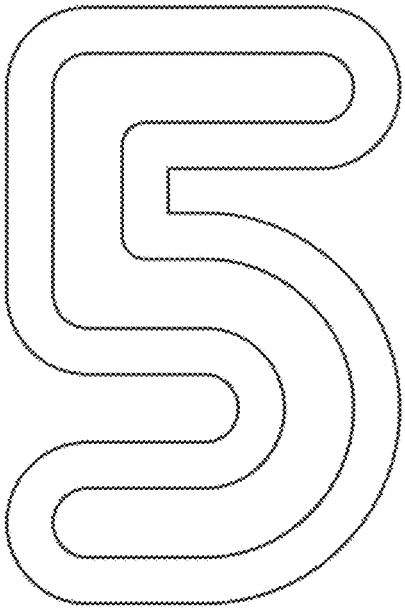
FIGS. 6A and 6B illustrate front aspects of the subject matter having different shapes such as figures and letters in accordance with embodiments of the invention.
Figure 6B:
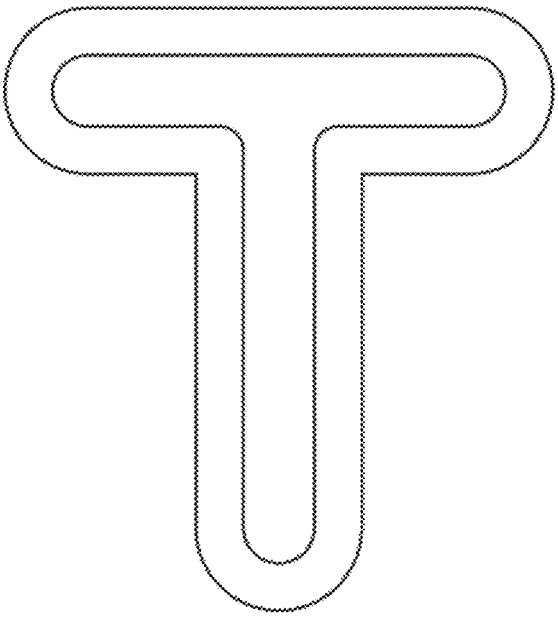

FIGS. 6A and 6B shows how frames can be customized to produce different letters and numbers. The letters and numbers can be constructed from various different shaped curved or corner sections attached each other or connected together using side rails 206 and optionally outer frame edges 208. Other embodiments of the constructed frame can be selected from the group: square, rectangle, triangle, pentagon, hexagon, polygon, circle, star, diamond, rhombus, upper or lower case letters, or number. In some embodiments of the invention, the curved or corner sections directly attach each other without the use of side rails, one end of the curved or corner section has a finger joint groove and the other end has a cooperating finger joint.

Figure 7A:
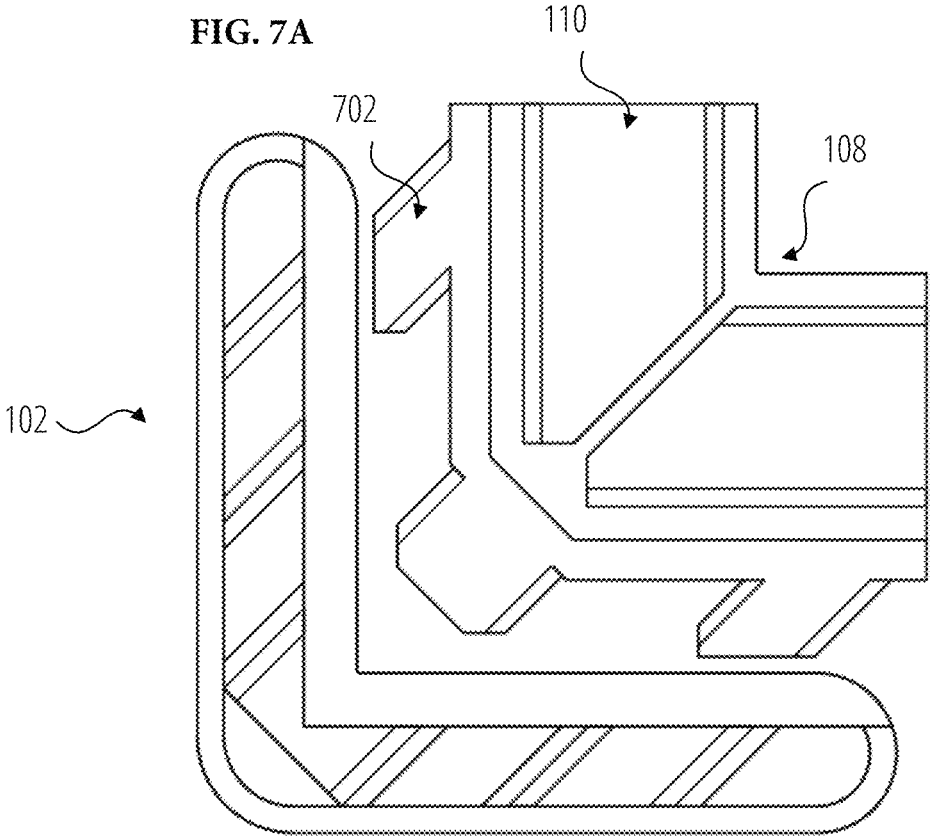
FIGS. 7A and 7B illustrate rear and perspective detailed aspects of the subject matter in accordance with the corner embodiments of the invention.
Figure 7B:
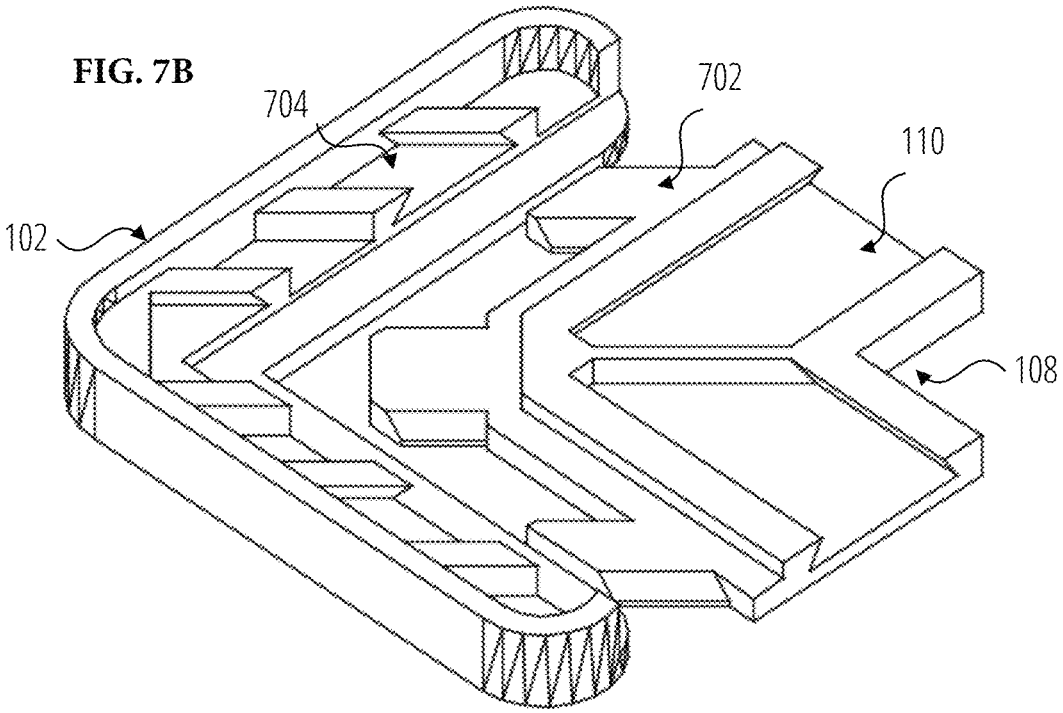

FIGS. 7A and 7B illustrate in greater detail the right-angled corner section 102 and the corner support member 108. The way in which the corner support member 108 attaches to the right-angled corner section 102 can be seen in one particular embodiment of the invention. Finger joints 702 can be seen protruding from the side edges of the corner support member 108, that cooperate with similarly sized and proportioned finger joint grooves 704 situated on the right-angled corner sections 102.

It is contemplated that finger joints 702 could be located on and project from the sides of the right-angled corner section 102, which cooperate with similarly sized and proportioned finger joint grooves 704 situated on the corner support members 108.

Various different means of attaching the right-angled corner sections 102 to the corner support members 108 known to those of skill in the field are contemplated to be within the scope of protection sought, including a variety of indents and projections, and therefore not limited to finger joints 702 and finger joint grooves 704.

Moreover, the corner sections and corner supports can be of various different angles, as shown in FIG. 1, indeed they can be curved. The way in which the corner sections and corner supports are attached may be via finger joints 702 and finger joint grooves 704, or by some other similar means that provides the same functionality.

Figure 8A:
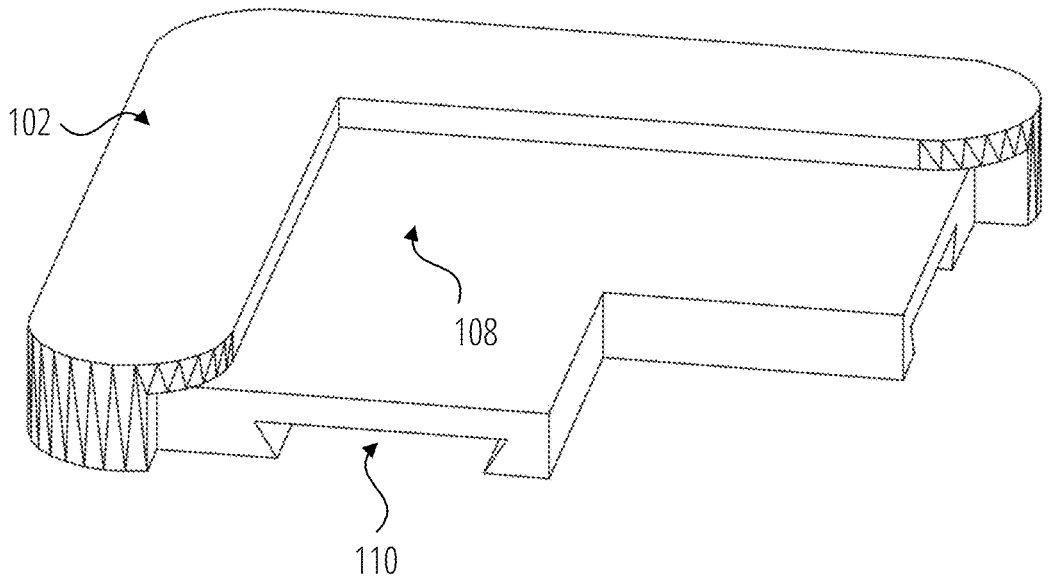
FIGS. 8A and 8B illustrate detailed perspective and front aspects of the subject matter in accordance with embellished embodiments of the invention.
Figure 8B:
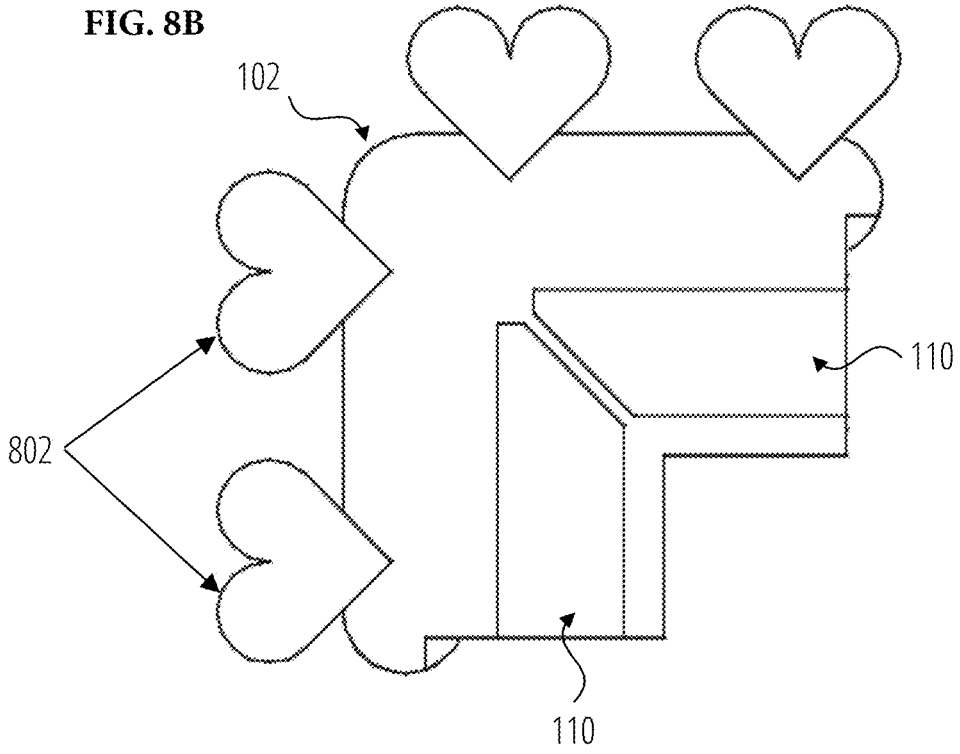

FIGS. 8A and 8B show perspective (FIG. 8A) and rear (FIG. 8B) views of right-angled corner sections 102 in accordance with embodiments of the invention. FIG. 7B illustrates the optional placement of embellishments 802 on the right-angled corner section 102.

Figure 9A:
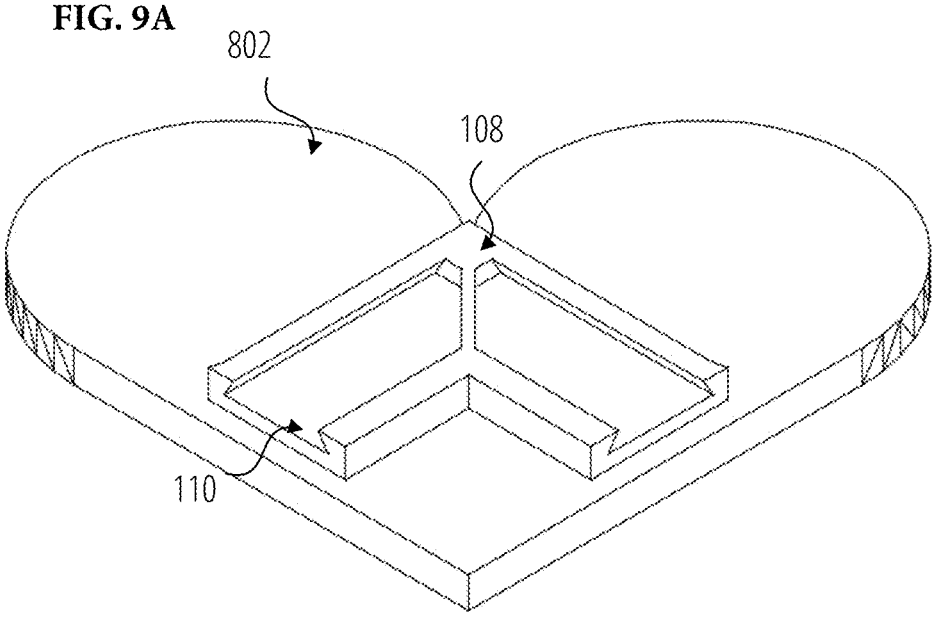
FIGS. 9A and 9B illustrate detailed perspective and rear aspects of the subject matter in accordance with embellishment embodiments of the invention.
Figure 9B:
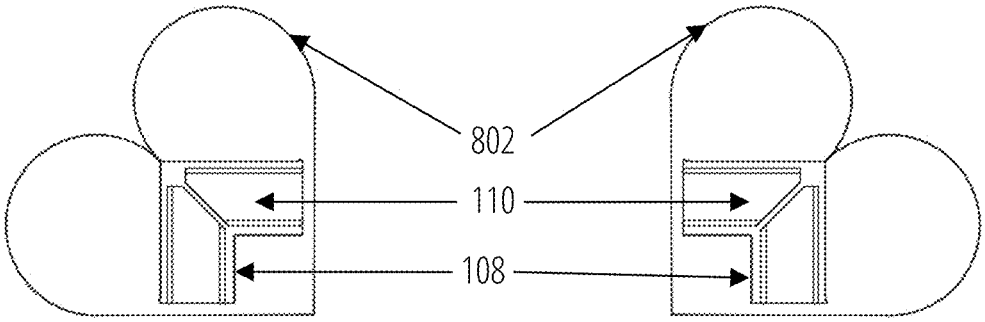

FIGS. 9A and 9B illustrate an alternative embodiment of the invention, wherein the embellishment 802 is the corner support member 108. In the embodiment shown the corner support member 108 is a right-angled corner support member 108. The embellishments can be structural in that they may form various different angled or shaped corner support members 108, or indeed the outer frame edges 208.

Figure 10A:
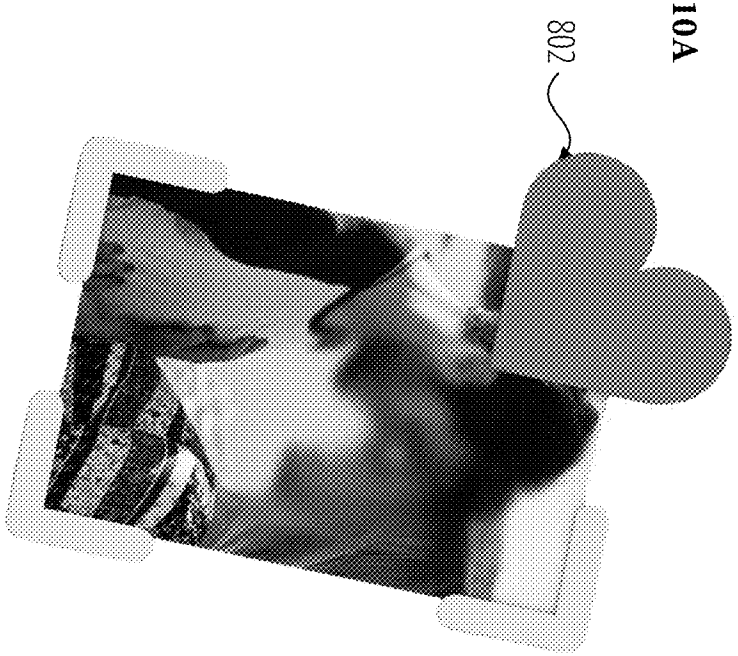
FIGS. 10A and 10B illustrate detailed aspects of the subject matter in accordance with additional embellishment embodiments of the invention.
Figure 10B:
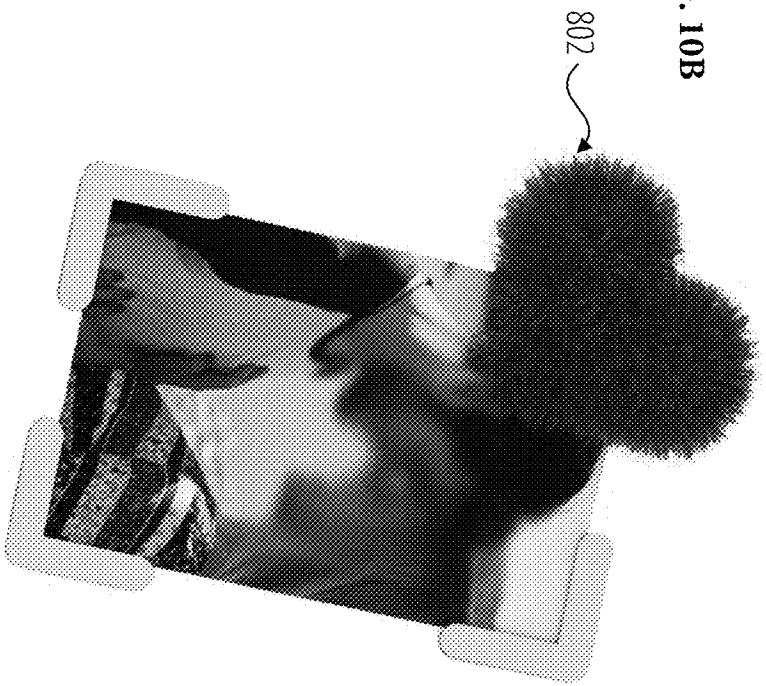

FIGS. 10A and 10B illustrate the attachment of embellishments 802 to the front surface 114 of the right-angled corner section 102, for example a laminar (FIG. 10A) or textured (FIG. 10B) shape.

Figure 11A:
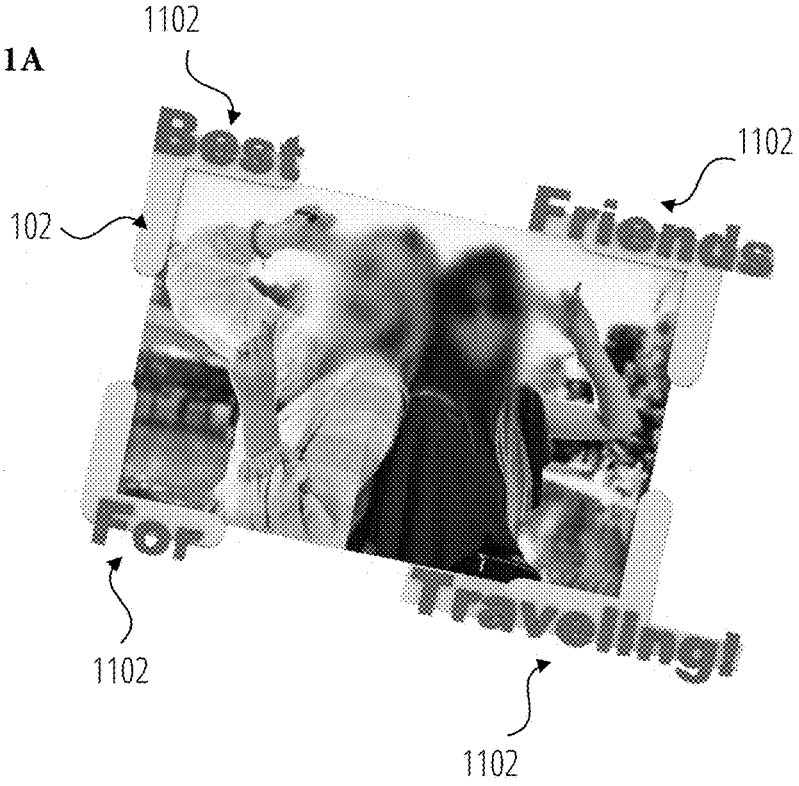
FIGS. 11A and 11B illustrate additional aspects of the subject matter in accordance with different embellishments and various side rails of embodiments of the invention.

FIG. 11A illustrates an example of alternative embellishments 1102 that can be used to adorn embodiments of the invention.

Figure 11B:
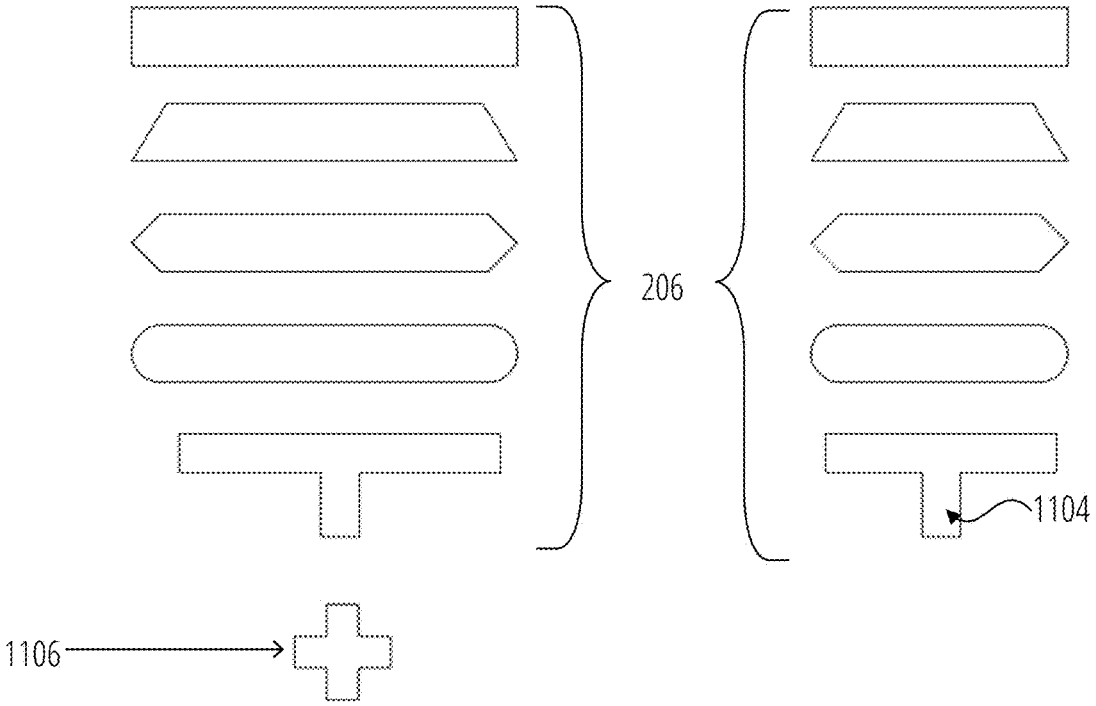

FIG. 11B illustrates examples of different profiles for the side rails 208. They could be any shape. The embodiments shown as a T-shaped side rail 1104 and a cross-shaped rail 1106 provide additional rigidity to larger frames having for longer rails. These pieces would require a different shaped socket in the corners. These designs are particularly suitable for embodiments of the invention that are 3D printed.

FIGS. 12A, 12B and 12C illustrate assembled and exploded views of an alternative method and structure of mounting the frame.

An additional element is shown in FIG. 12C, which is a mounting member 1202. One side of the mounting member 1202 has a flat surface that can accommodate a fixing such as a Command™ strip or magnet and another attachment means 1204 that will engage with the frame. In the embodiment shown, engagement with the frame is provided by means of a cooperating attachment means 1206 attached to the frame which also has a cooperating mounting member 1208 that engages with the attachment means 1204.

In the embodiment as shown, the attachment means 1204 and cooperating attachment means 1206 cooperate in a friction fit relationship. Ridges may be provided on the contacting surfaces of the attachment means 1204 and cooperating attachment means 1206 to improve the friction fit.

Numerous different types of mounting members 1202 for attachment to the frame and will be known to those of skill in the field are contemplated to be within the scope of protection sought, and are therefore not limited to specific mounting members 1202 and cooperating mounting members 1208 as disclosed.

The mounting member 1202 as illustrated in FIG. 12B comprise an essentially flat mounting surface 1214 that may have a magnet or an appropriate fixing, such as a double-sided sticky pad or patch or a Command™ strip attached to the mounting surface 1214. The mounting member 1202 has an opposing surface 1210 having an attachment means 1204 for connecting to the frame. In the illustrated embodiment, the attachment means 1204 is a disc that protrudes from the opposing surface 1210. The outer edge of the disc has a friction fit surface 1212.

The cooperating mounting member 1208 as illustrated has a clip like structure that, on one side is sized and proportioned to engage with the side rail 206 of the frame. On an opposite surface, is attached a cooperating attachment means 1206. In the illustrated embodiment, the cooperating attachment means 1206 comprises a structure that is sized and proportioned to engage attachment means 1204. For example, a structure having a disc shaped indentation, wherein the edges of the disc shaped indentation have a friction fit surface 1212 that cooperates with the friction fit surface 1212 on the attachment means 1204.

In an alternative embodiment of the invention, the mounting member 1202 may comprise the structure having a disc shaped indentation, wherein the edges of the disc shaped indentation have a friction fit surface 1212 that cooperates with the friction fit surface 1212 on the cooperating mounting member 1208.

The embodiment as illustrated in FIGS. 12A and 12B allows the frame to be hung vertically or at different angles, including at right angles. If different sized/weighted corners pieces are used, this would cause the frame to not hang straight. Similarly, the weight of embellishments on one or more positions on the frame could cause the frame to hang unevenly. Use of the adjustable wall mount would compensate for this imbalance.

FIGS. 13A, 13B, and 13C show an embodiment of the invention having a central supporting member 1302 that is adapted to contain a magnet 1310.

FIG. 13B shows an embodiment having a central supporting member 1302 that is selected having a dimension that spans a central portion of the frame when constructed. The central supporting member 1302 in the illustrated embodiment is configured at its outer edge to engage with the side rails 206 of the frame. In one embodiment of the invention, side rail attachment 1304, such as a clip like structure, is sized and proportioned to engage with the side rail 206 of the frame. In some embodiments, a cooperating notch protrusion 1306 is formed in the side rail attachment 1304 that cooperates with central notches 202 on the side rails 206.

FIG. 13C shows the central supporting member 1302 fixed in place in the mid-section of a frame. The combination of the cooperating notch protrusion 1306 and central notch 202 provides additional structural support and retains the central supporting member 1302 in the mid-section of the frame and prevents slippage. The central supporting member 1302 has a magnet holder 1308 affixed to the rear facing side of the central supporting member 1302. A similarly shaped and sized magnet 1310 being fixed to the inside of the space formed within the magnet holder 1308 by glue or friction fit.

FIG. 13A illustrates a mounting member 1202 having a metal or magnet holder 1312 formed on a frame facing surface. A metal disc or magnet 1314 is fixed inside the metal or magnet holder 1312. The wall facing surface of the mounting member 1202 can be affixed to the wall or ceiling via an appropriate fixing, such as a double-sided sticky pad or patch or a Command™ strip.

Clearly, this embodiment can be attached directly to a metal surface, without the use of the mounting member 1202.

Figure 14A:
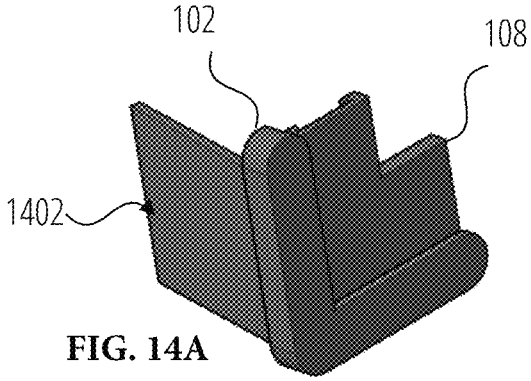
FIGS. 14A, 14B and 14C illustrate front perspective aspects of the subject matter in accordance with freestanding corner supports of embodiments of the invention.
Figure 14B:
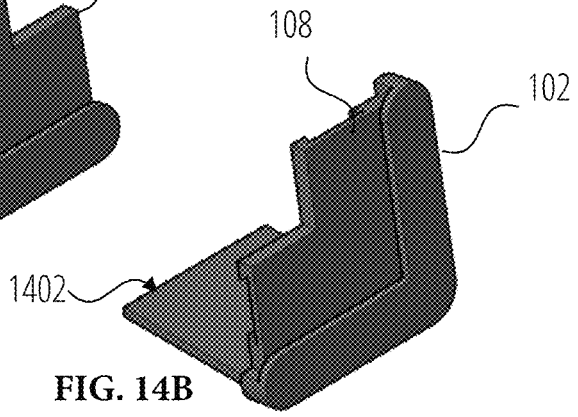
Figure 14C:
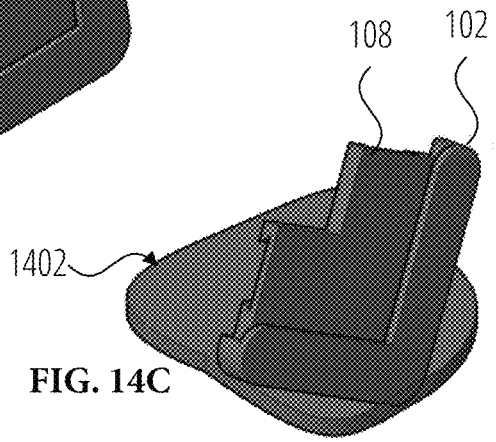

FIGS. 14A, 14B, and 14C illustrates a number of variations shown as perspective front views of freestanding supports 1402 for right angled corner sections 102.

FIG. 14A shows a freestanding support 1402 that extends in an essentially vertical orientation from a right-angled corner section 102. FIG. 14B shows a freestanding support 1402 that extends in a horizontal orientation from a right-angled corner section 102. FIG. 14C shows a right-angled corner section 102 that is essentially centrally attached to a freestanding support 1402.

The freestanding support 1402 comprises an essentially planar structure that is attached, either at the corner or along an edge of the right-angled corner section 102, to the right-angled corner section 102 at an angle that allows the frame to be freestanding. The freestanding supports 1402 can be affixed to any shaped or angled corner section, not just a right-angled corner section 102.

Figure 15A:
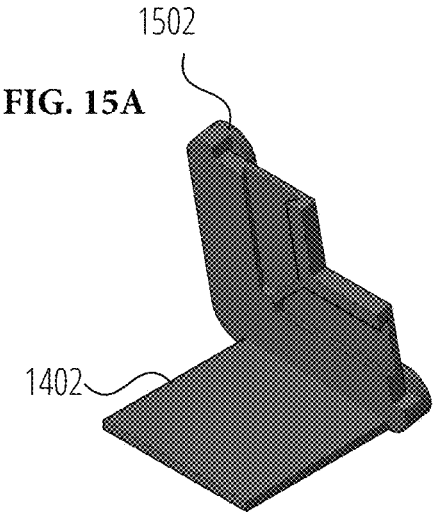
FIGS. 15A and 15B illustrate rear perspective aspects of the subject matter of a freestanding corner support in accordance with one embodiment of the invention.
Figure 15B:
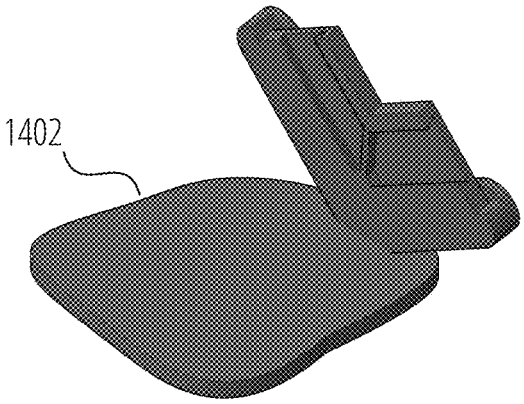

FIGS. 15A and 15B illustrate a variation shown as perspective rear views of freestanding supports 1402 for right angled corner sections 102.

FIG. 15A shows a freestanding support 1402 that extends in a horizontal orientation from a right-angled corner section 102. FIG. 15B shows a right-angled corner section 102 that is essentially centrally attached to a freestanding support 1402.

Figure 16:
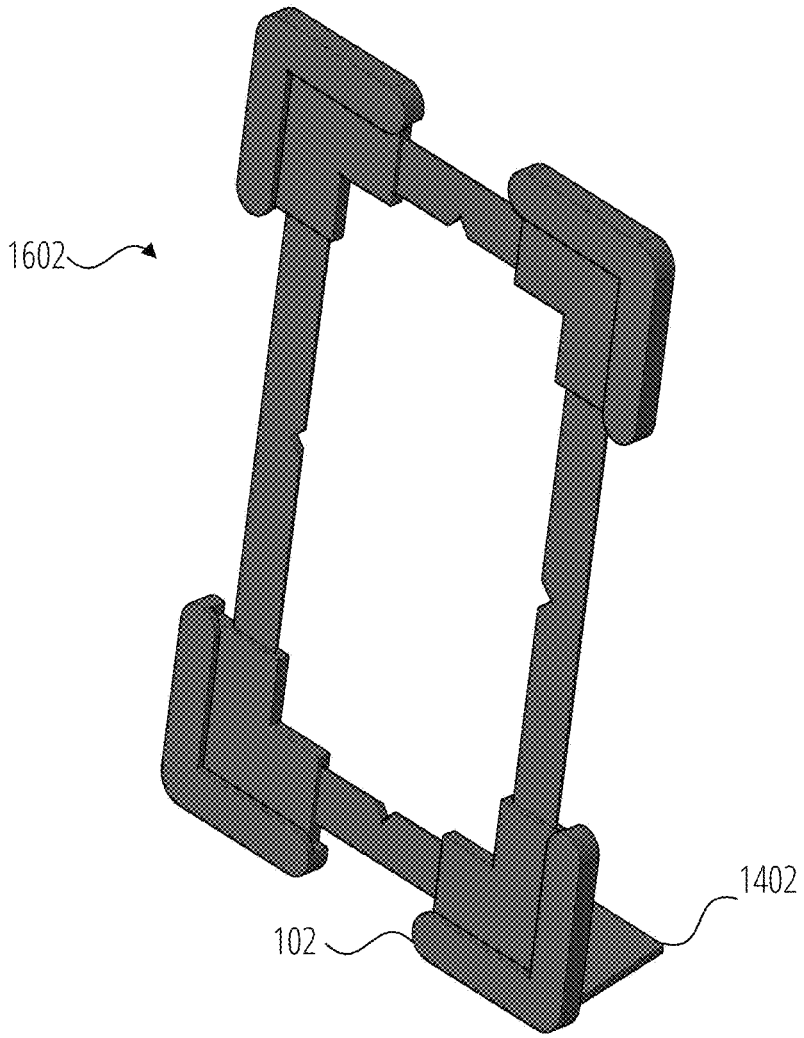
FIG. 16 illustrates a front perspective aspect of the subject matter of a complete frame having a freestanding corner support in accordance with an embodiment of the invention.

FIG. 16 shows a front perspective view of a frame having a freestanding support 1402 affixed in a horizontal orientation behind the frame. This particular view illustrates an angle of connection that results in the frame being supported at an angle slightly offset from vertical.

Figure 17:
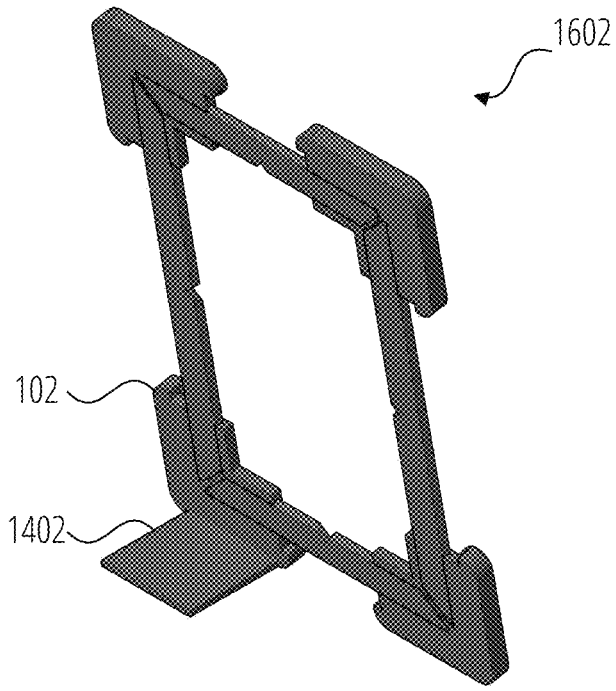
FIG. 17 illustrates a rear perspective aspect of the subject matter of a complete frame having a freestanding corner support in accordance with one embodiment of the invention.

FIG. 17 shows a rear perspective view of a frame having a freestanding support 1402 affixed in a horizontal orientation also behind the frame.

Figure 18:
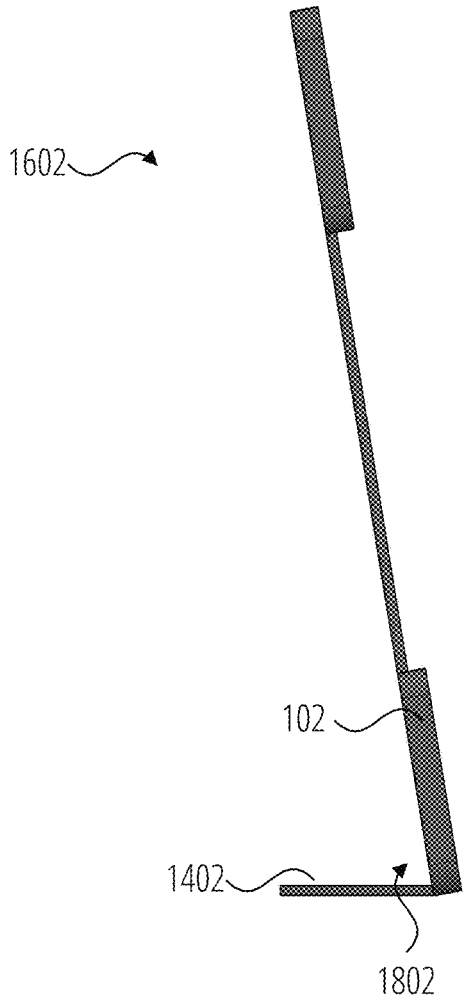
FIG. 18 illustrates a side perspective aspect of the subject matter of a complete frame having a freestanding corner support in accordance with one embodiment of the invention.

FIG. 18 is a side view that illustrates a freestanding frame 1602 having an angle of inclination 1802 resulting in the frame being supported at an angle slightly offset from vertical. Typically, it is envisioned that angle of inclination 1802 between 60-85° would provide a stable support.

Figure 19:
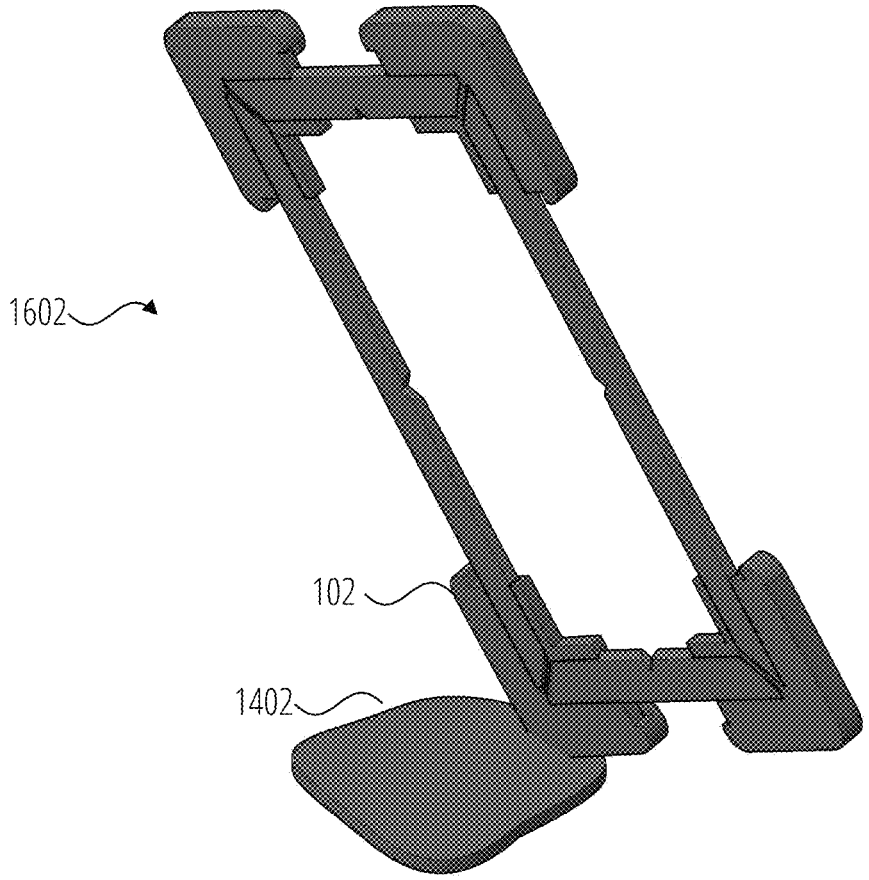
FIG. 19 illustrates an alternative rear perspective aspect of the subject matter of a complete frame having a freestanding corner support in accordance with one embodiment of the invention.

FIG. 19 shows a freestanding support 1402 that is attached to a corner of a right angled corner section 102 resulting in a clockwise tilted orientation when viewed from the front of the frame.

Figure 20:
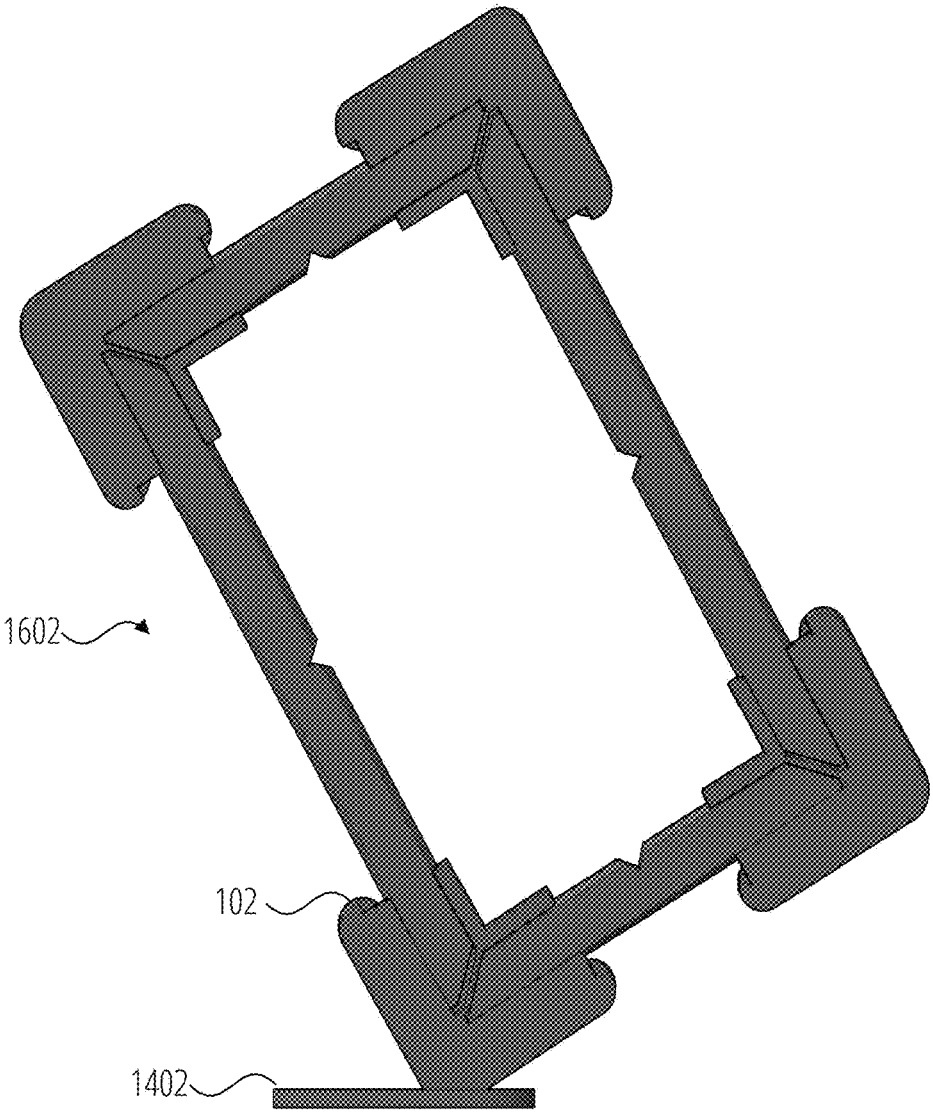
FIG. 20 illustrates another rear perspective aspect of the subject matter of a complete frame having a freestanding corner support in accordance with one embodiment of the invention.

FIG. 20 shows a rear view of a freestanding frame 1602. The freestanding support 1402 is attached to a corner of a right-angled corner section 102 resulting in a clockwise tilted orientation when viewed from the front of the frame.

Figure 21:
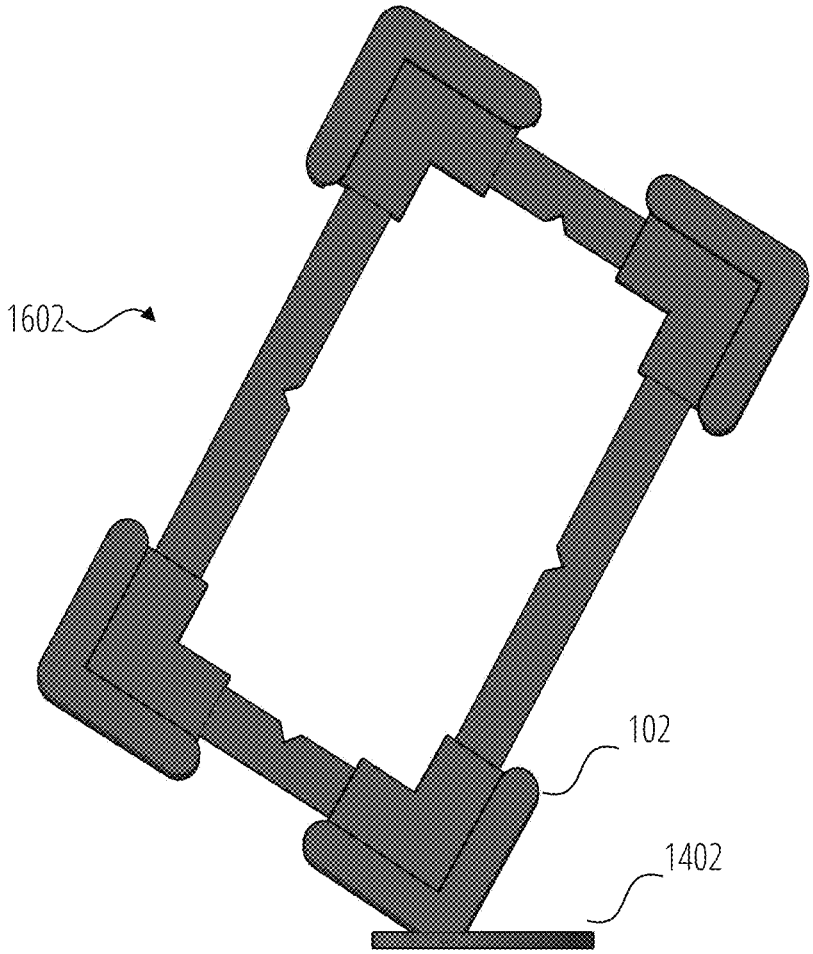
FIG. 21 illustrates a front perspective aspect of the subject matter of a complete frame having a freestanding corner support in accordance with one embodiment of the invention.

FIG. 21 shows a front view of a freestanding frame 1602. The freestanding support 1402 is attached to a corner of a right-angled corner section 102 resulting in a clockwise tilted orientation when viewed from the front of the frame.

Figure 22:
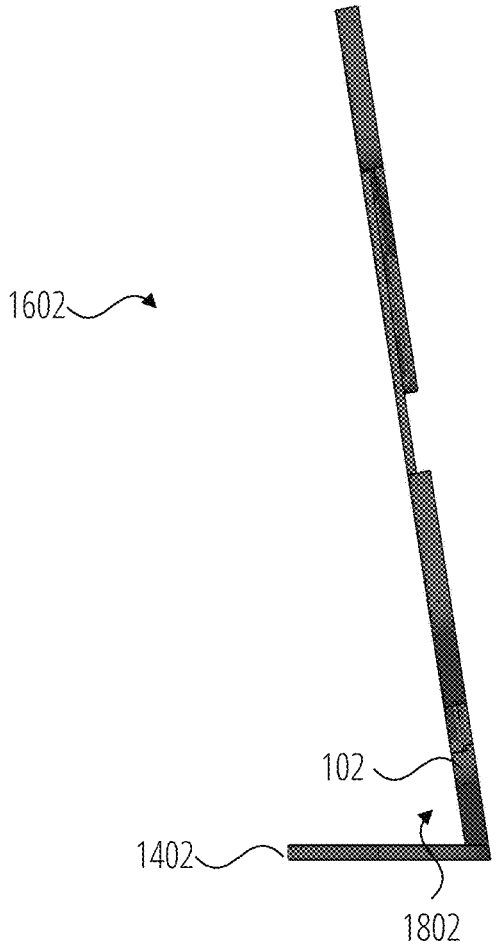
FIG. 22 illustrates a side perspective aspect of the subject matter of a complete frame having a freestanding corner support in accordance with one embodiment of the invention.

FIG. 22 is a side view that illustrates a freestanding frame 1602 having an angle of inclination 1802 resulting in the frame being supported at an angle slightly offset from vertical. Typically, it is envisioned that angle of inclination 1802 between 60-85° would provide a stable support.

Figure 23:
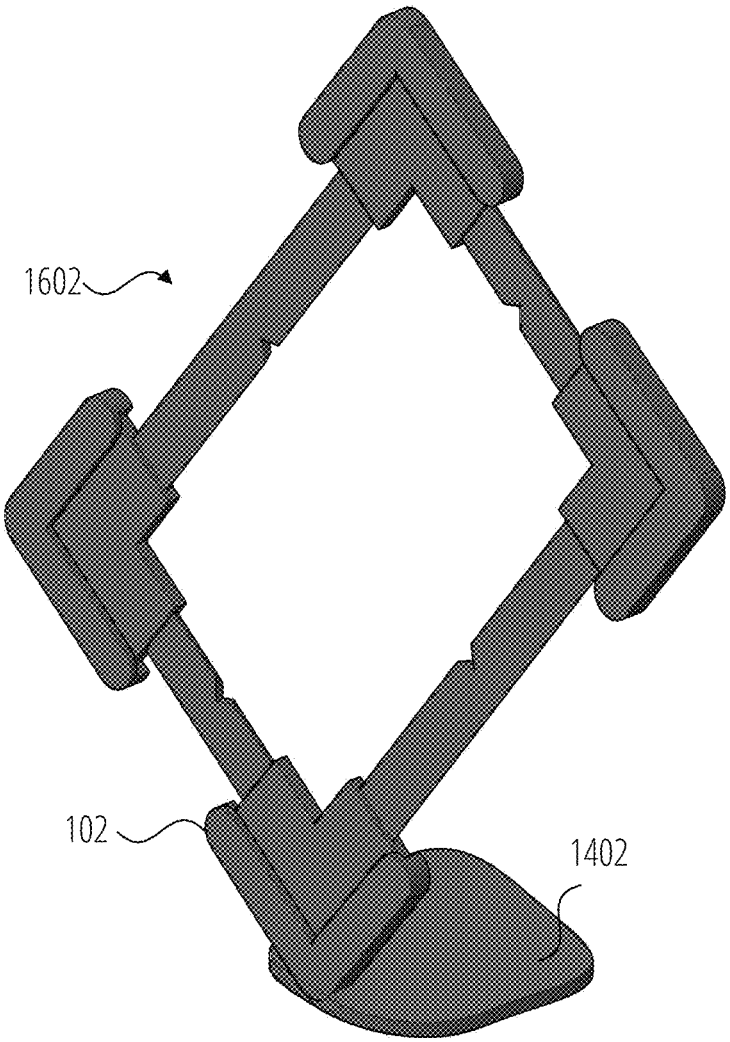
FIG. 23 illustrates a front perspective aspect of the subject matter of a complete frame having a freestanding corner support in accordance with one embodiment of the invention.

FIG. 23 shows a front view of a freestanding frame 1602. The freestanding support 1402 is attached to a corner of a right-angled corner section 102 resulting in a clockwise tilted orientation when viewed from the front of the frame.

Figure 24:
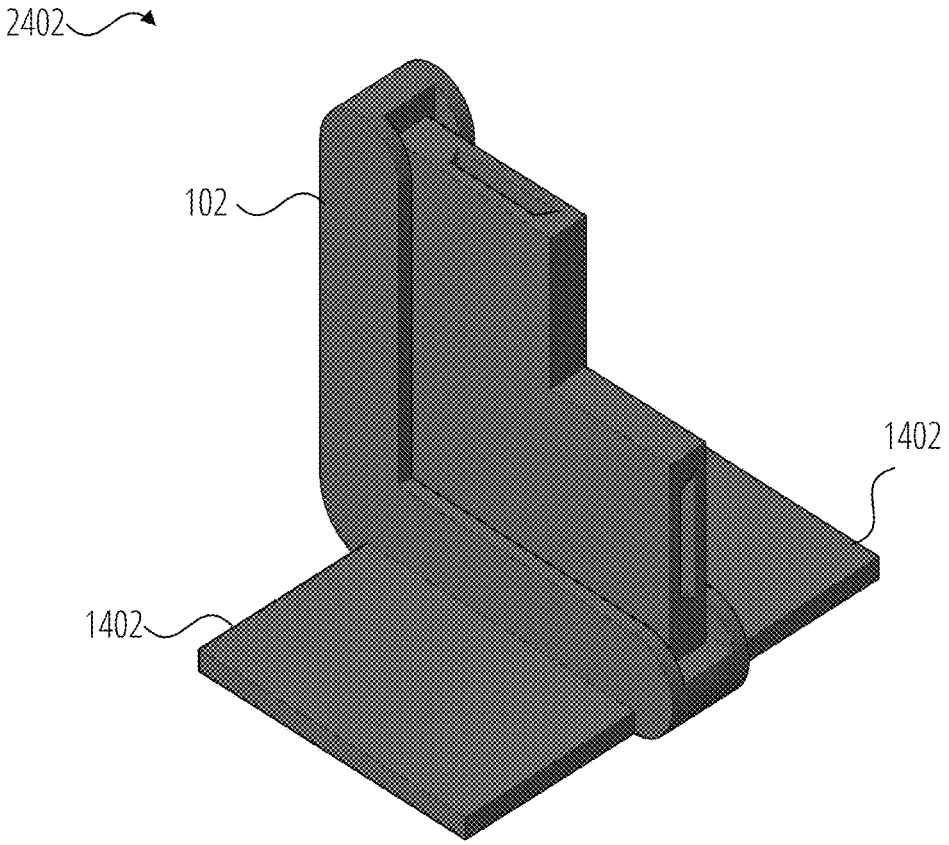
FIG. 24 illustrates a perspective aspect of the subject matter of a double sided freestanding support corner in accordance with one embodiment of the invention.

FIG. 24 shows a right-angled corner section 102 having a pair of freestanding supports 1402. One of the freestanding supports 1402 extends forward in front of the frame and the other freestanding support 1402 extends backwards behind the frame.

Figure 25:
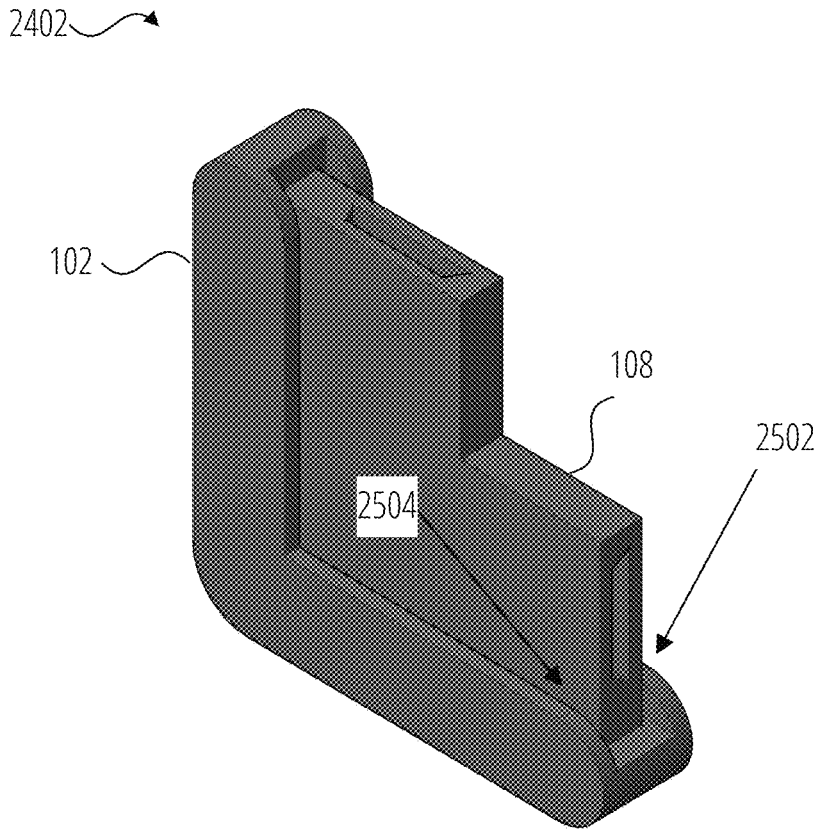
FIG. 25 illustrates a perspective aspect of the subject matter of a double sided corner in accordance with one embodiment of the invention.

FIG. 25 shows a right-angled corner section 102 that is designed to be viewable from both sides. This double-sided corner 2402 embodiment of the invention can be used in conjunction with various double-sided frames, including, but not limited to those illustrated in FIGS. 14-25. A first photo 2504 or print or work of art can be inserted as shown on one side of the double-sided corner 2402 and a second photo 2502 or print or work of art can be inserted as shown on one side of the double-sided corner 2402.

Figure 26A:
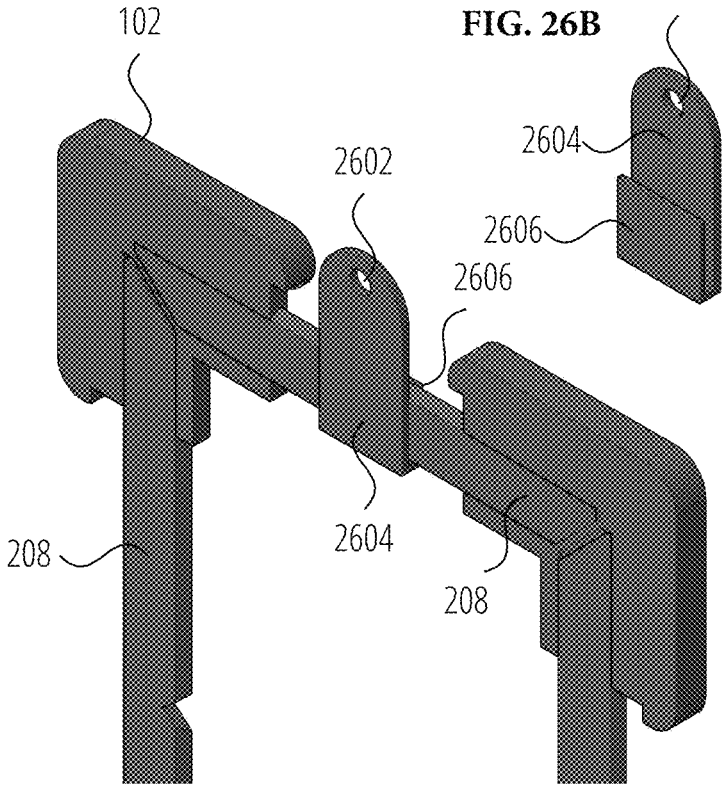
FIGS. 26A and 26B illustrate perspective aspects of the subject matter of a hanging member in accordance with one embodiment of the invention.
Figure 26B:
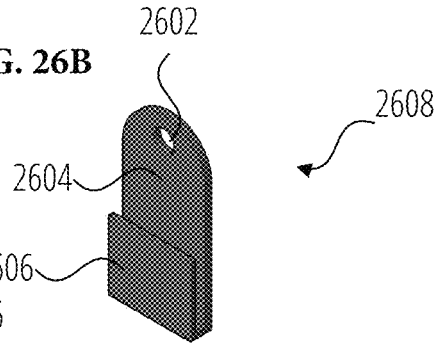

FIGS. 26A and 26B illustrate a hanging member 2608 and its connection to a side rail 206 of the constructed frame.

FIG. 26B shows the structure of an embodiment of the hanging member 2608 in greater detail. The hanging member 2608 comprises a connecting member 2604 having a lip 2606 and a hole 2602.

FIG. 26A shows the lip 2606 of the hanging member 2608 overlapping with a side rail 206 of the constructed frame. The hanging member 2608 can be attached to the wall via the hole 2602. The attachment can be directly using a pin or nail, or a length of ribbon or string can be looped through the hole 2602 and then hung from a pre-existing feature or a pin or nail.

Figure 27:
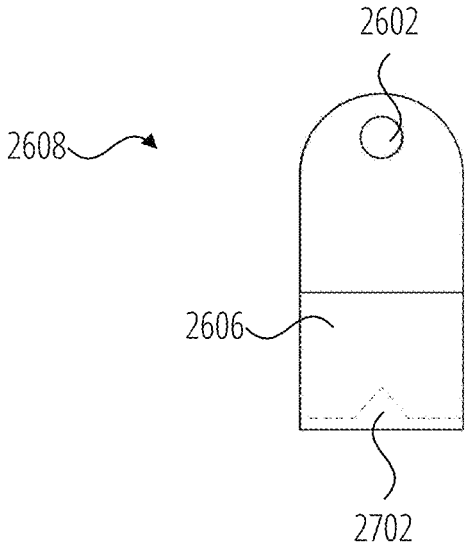
FIG. 27 illustrates front aspects of the subject matter of a hanging member in accordance with one embodiment of the invention.

FIG. 27 shows a more detailed auxiliary view of a hanging member 2608.

This illustration shows that one embodiment of the hanging member 2608 that has a notch cooperating structure 2702 formed in the gap between the lip 2606 and the connecting member 2604. The notch cooperating structure 2702 is shaped and configured to correspond to a notch 202 that is present in the center of a side rail 206.

Figure 28A:
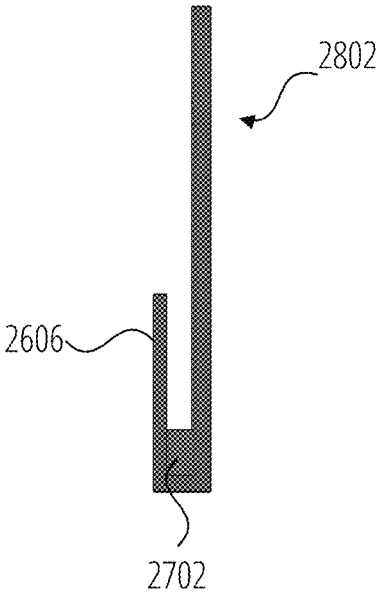
FIGS. 28A and 28B illustrate side aspects of the subject matter of hanging members in accordance with two different embodiments of the invention.
Figure 28B:
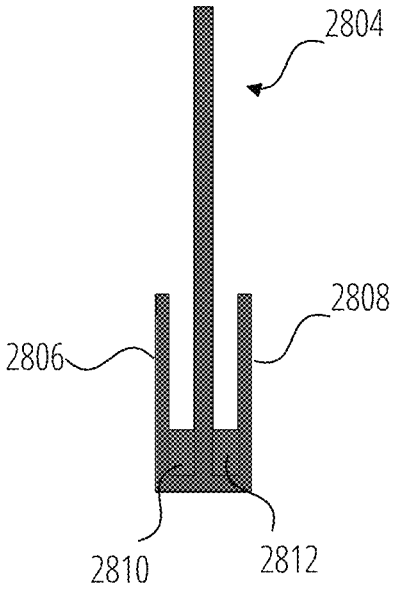

FIGS. 28A and 28B illustrate side views of alternative views of embodiments of hanging members 2608.

FIG. 28A shows a side view of a single hanging member 2802, as illustrated in FIGS. 26A and 26B and FIG. 27. The notch cooperating structure 2702 can clearly be seen positioned between the connecting member 2604 and the lip 2606

FIG. 28B shows a side view of a double hanging member 2804. In this embodiment, a central connecting member 2604 is flanked on both sides by lips that each engage with side rails 206 of a constructed frame. The first notch cooperating structure 2810 can clearly be seen positioned between the one side of the connecting member 2604 and the first lip 2806. The second notch cooperating structure 2812 can clearly be seen positioned between the other side of the connecting member 2604 and the second lip 2808. In operation, a first constructed frame is connected to the first lip 2806, and a second constructed frame is connected to the second lip 2808.

This double hanging member 2804 therefore allows two frames to be hung, back-to-back, providing a double-sided frame. The double-sided frame can be hung in such a way, typically using string or ribbon, such that the frames can rotate, or be rotated.

Figure 29A:
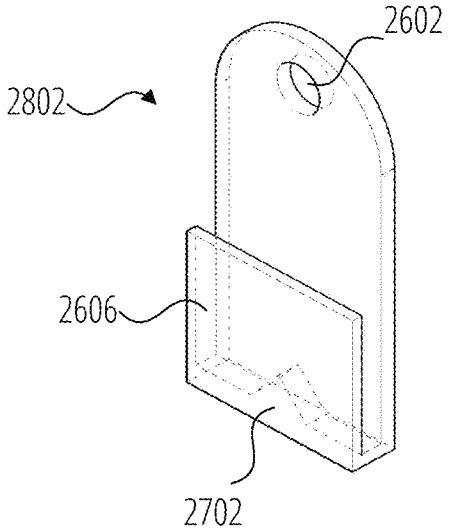
FIGS. 29A and 29B illustrate perspective aspects of the subject matter of hanging members in accordance with two different embodiments of the invention.
Figure 29B:
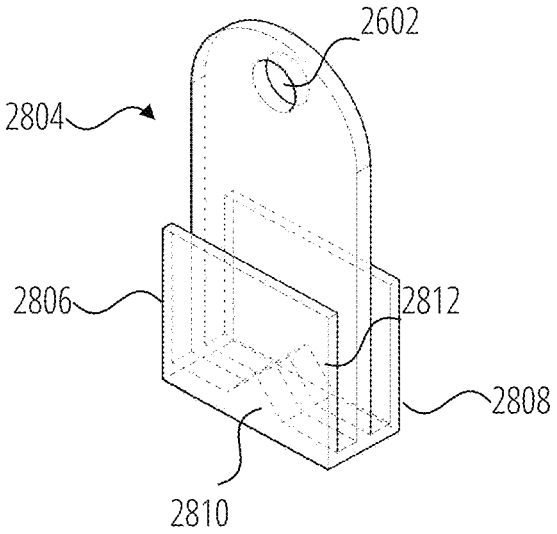

FIGS. 29A and 29B illustrate perspective auxiliary views of embodiments of a single hanging member 2802 and a double hanging member 2804.

FIG. 29A essentially corresponds to a perspective view of the embodiment as illustrated in FIG. 27.

FIG. 29B essentially corresponds to a perspective view of the embodiment as illustrated in FIG. 28B. This figure illustrates an embodiment of the double hanging member 2804 that has a first notch cooperating structure 2810 formed in the gap between the first lip 2806 and the connecting member 2604 and a second notch cooperating structure 2812 formed in the gap between the second lip 2808 and the connecting member 2604. The first notch cooperating structure 2810 and the second notch cooperating structure 2812 are shaped and configured to correspond to notches 202 that are present in the center of a side rails 206.

Figure 30:
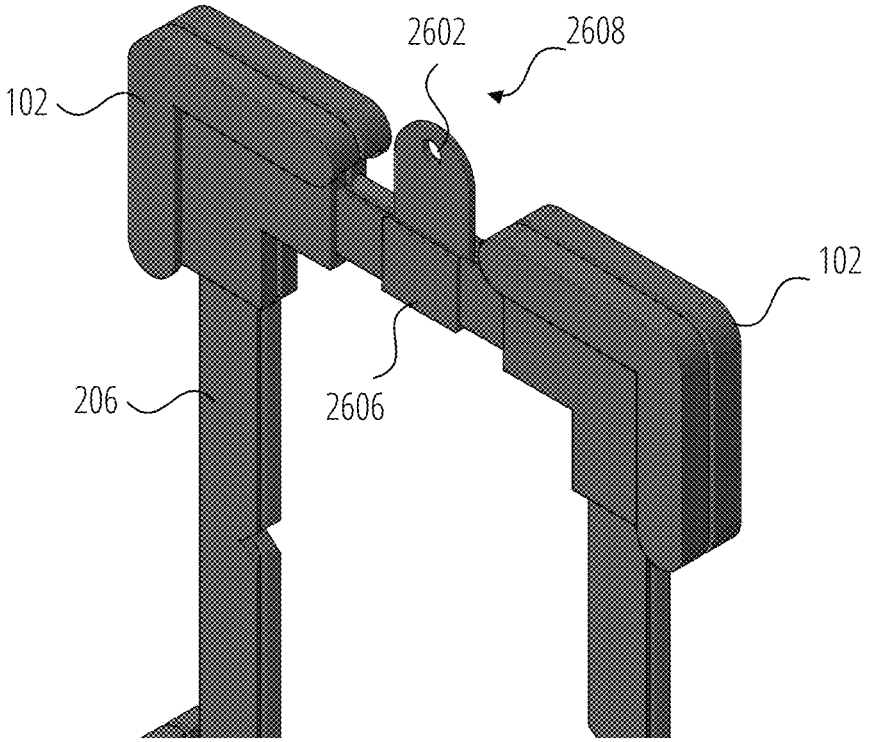
FIG. 30 illustrates a perspective aspect of the subject matter of a hanging member attached to a complete frame in accordance with an embodiment of the invention.

FIG. 30 illustrates a hanging member 2608 and its connection to a side rail 206 of the constructed frame.

This figure shows the lip 2606 of the hanging member 2608 overlapping with a side rail 206 of the constructed frame. The hanging member 2608 can be attached to the wall via the hole 2602. The attachment can be directly using a pin or nail, or a length of ribbon or string can be looped through the hole 2602 and then hung from a pre-existing feature or a pin or nail.

Figure 31A:
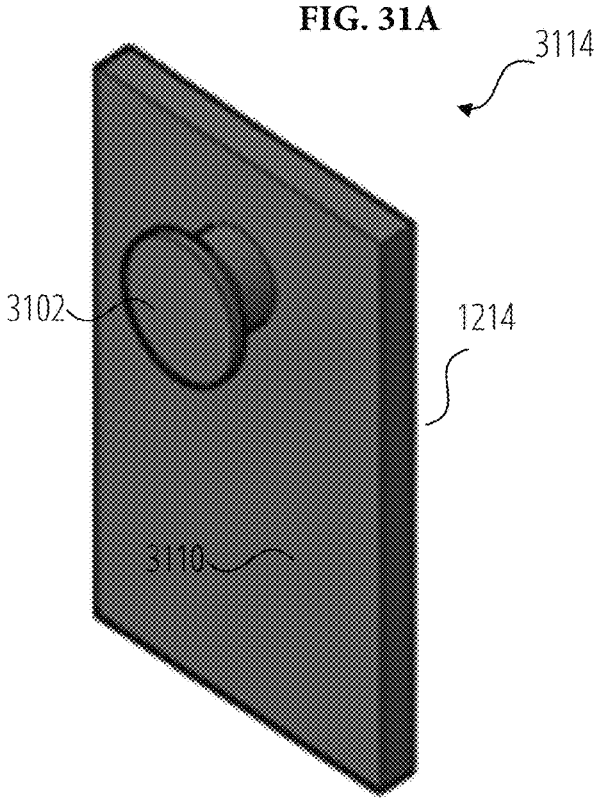
FIGS. 31A and 31B illustrate a perspective aspect of the subject matter of a stand-off extension in accordance with one embodiment of the invention.
Figure 31B:
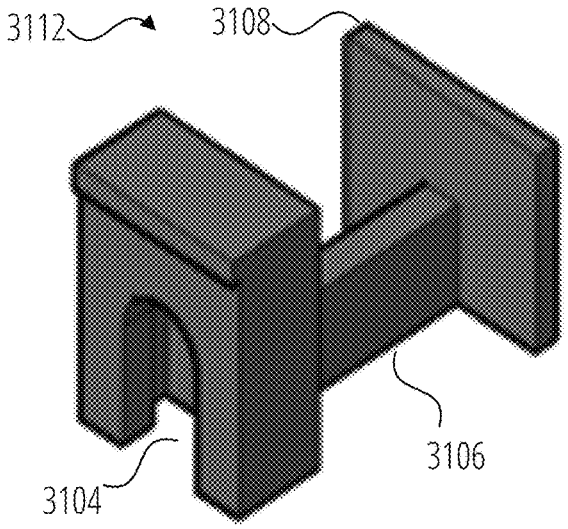

FIGS. 31A and 31B show an extension member that can be used to allow the frame to be offset from the mounting surface.

FIG. 31A shows a stand-off extender mount 3114 part of one embodiment of the stand-off extender 3112.

A wall stand-off attachment member 3110 having an essentially planar structure has a mounting surface 1214 and an opposite surface that is adapted to engage with a stand-off extender 3112. In the illustrated embodiment, the opposite surface is adapted to engage with a stand-off extender 3112 by way of a stand-off connector 3102.

FIG. 31B shows a stand-off extender 3112 in accordance with an embodiment of the invention. The stand-off extender 3112 has a stand-off attachment member 3104 that cooperates, at one end, with the stand-off connector 3102. The other end of the stand-off connector 3102 has a frame connection member 3108.

FIGS. 32A, 32B, 32C, 32D and 32E shows perspective views of various extenders in accordance with embodiments of the invention.

Figure 32A:
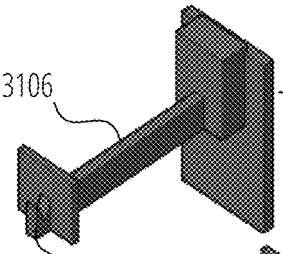
FIGS. 32A, 32B, 32C, 32D and 32E illustrate a perspective aspect of the subject matter of various different sizes of stand-off extensions in accordance with one embodiment of the invention.
Figure 32B:
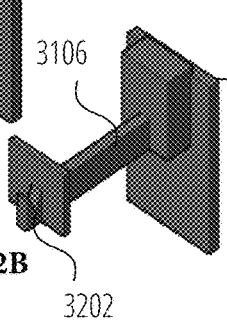
Figure 32C:
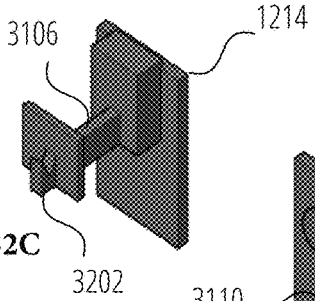
Figure 32D:
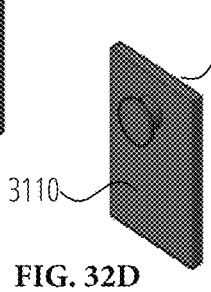
Figure 32E:
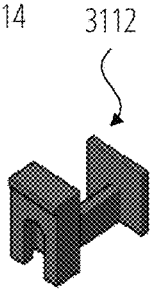

FIGS. 32D and 32E correspond respectively to the embodiments of the invention illustrated in FIGS. 31A and 31B.

FIGS. 32A, 32B and 32C show front perspective views of assembled extenders formed by the attachment of a stand-off extender 3112 to a stand-off extender mount 3114. This particular view of the assembled extenders illustrates a frame connection member 3108 stand-off extenders 3112. The wall stand-off attachment members 3110 have different length stand-off extensions 3106 that result in the assembled frame being offset from the mounting surface by different distances.

In the illustrated embodiments, the frame connection member 3108 comprises a stand-off notch connector 3202 that is sized and dimensioned to cooperate with a notch 202 on the side rails 206.

Figure 33:
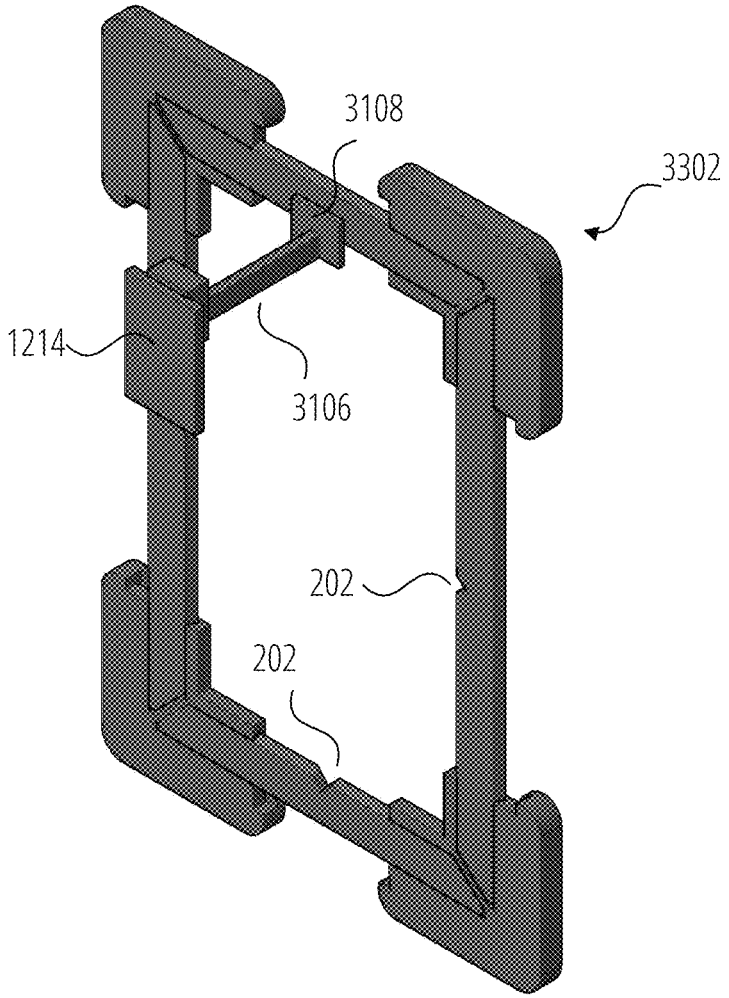
FIG. 33 illustrates a rear perspective aspect of the subject matter of a stand-off extension attached to a completed frame in accordance with one embodiment of the invention.

FIG. 33 shows a constructed frame 3302, having a notch 202 (not visible) positioned at a mid-point on an upper horizontal side rail 206. The stand-off extender 3112 having a stand-off notch connector 3202 that is sized and dimensioned to cooperate with a notch 202 on the side rails 206.

Figure 34:
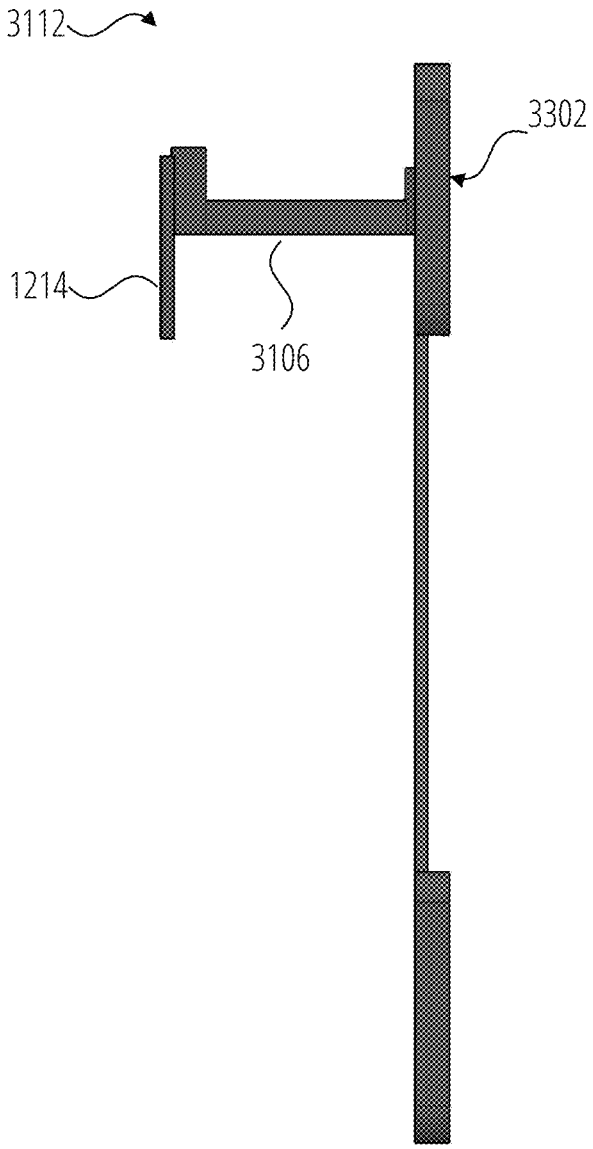
FIG. 34 illustrates a side aspect of the subject matter of a stand-off extension attached to a completed frame in accordance with one embodiment of the invention.

FIG. 34 shows a side view of the embodiment of the invention illustrated in FIG. 33.

The mounting surface 1214 is for attachment to a wall or other essentially vertical surface.

Hence the adjustable wall mount can be used such that if you put decorations on a frame, it would not tilt one way or the other, or in the alternative, if you choose you could mount the frame on an angle on purpose. The connection between the attachment means 1204 and the cooperating attachment means 1206 can be a magnet or a friction fit or faceted/ribbed type interference to give incremental adjustments.

Numerous different types of mounting members 1202 for attachment to the frame and will be known to those of skill in the field are contemplated to be within the scope of protection sought, and are therefore not limited to specific mounting members 1202 and cooperating mounting members 1208 as disclosed.

"Display members" include the various different structural features that are used to display the constructed frames. In one embodiment, the display members are notches 202 formed in the center of the side rails 206, see FIGS. 3A, 3B, 3C and 3D, 4A and 4B. The constructed frames 3302 can then be displayed on a wall by engaging the notch 202 on the upper horizontal side rail 206 with a nail or hook that extends from the surface of the wall.

In another embodiment, the display members comprise mounting members 1202 and cooperating mounting members 1208, see FIGS. 12A, 12B and 12C and 13B and 13C. In some embodiments, the mounting members 1202 and cooperating mounting members 1208 may be configured to further cooperate with one or more of the notches 202 on the side rails 206, see FIGS. 13B and 13C. Additional embodiments of this type of display members may include a magnet 1310 disposed within a magnet holder 1308.

In another embodiment, the display members comprise a freestanding support 1402 that extends from, or is attached to, a corner section of the constructed frame such as a right-angled corner section 102. The freestanding support 1402 may extend in an essentially vertical orientation or a horizontal orientation from the right-angled corner section 102. Alternatively, the right-angled corner section 102 may be attached to a central or edge section of the freestanding support 1402. In some embodiments, the right-angled corner section 102 and the freestanding support 1402 are fabricated as a unitary structure by the freestanding support 1402 being molded or printed as part of the right angled corner section 102. The freestanding support 1402 display member allows the constructed frame to be displayed of a horizontal surface such as a table.

In another embodiment, the display members comprise a hanging member 2608 that engages with the side rail 206 in the region of a notch 202 via a lip 2606. The hanging member 2608 has a hole 2602 that engages, either directly or via a piece of string or ribbon, with a nail or hook that extends from the surface of the wall or a hook in a ceiling. In some embodiments, this display member is double sided in that it has two opposing lips 2606 that can interact with the side rails 206 of two constructed frames 3302. In this embodiment, two frames can be hung back-to-back, each displaying different photos or pictures. If the embodiment with back-to-back frames is hung from a hook or ceiling, both pictures of photos can be seen as the frame rotates.

In another embodiment, the display members comprise a stand-off extender 3112 that is configured to attach at one end to the constructed frame and at the other end to a wall or vertical surface. Again, in some embodiments of the invention, the stand-off extender 3112 is attach at one end to the notch 202 in a side rail 206 of the constructed frame.

The above described parts, may be sold in kits containing sufficient parts to make a specific frame, or they may be sold with a variety of different parts that enable the purchaser to create different shapes and sized frames. Some kits may be sold with just the corner sections and side rail 206, whereas others may also contain the outer frame edges 208. In some embodiments, the side rail 206 and outer frame edges 208 are marked to indicate the size of frame that they will produce when attached to a suitable corner piece, which makes construction of the frame easier.

The kits may contain one or more sheets of clear or tinted acrylic, such as Perspex™, to insert into the frame to protect the photo, card or collage that is being framed. In some instances, precut acrylic sheets may be included at predetermined shapes and sizes. Other kits may also contain arced sections allowing the purchaser to create circular or oval frames. The pieces may be colored or textures, and additional embellishments 802, including but not limited to stickers, gem stones, foam shapes, letters or words may also be included.

The frames can be constructed by the purchaser by selecting the shape and number of corners sections and corner supports appropriate to accommodate the item to be framed. Side rail 206 are then selected that fit into the space between each corner. The corner supports are then attached to the corner sections. The side rails 206 are then slid into each side rail track 110 on each corner support member 108. When the complete frame is constructed, the item to be framed, optionally protected with a sheet of appropriately sized acrylic, such as Perspex™, is then inserted into the frame.

If the purchaser wishes for the frame to have outer frame edges 208 they can be clipped onto the side rail 206 prior to inserting the item to be framed. Similarly, if the purchaser wants to include some form of structural embellishment 802, that can be done by substituting the structural feature for the element it is replacing during the construction of the frame. If the embellishments 802 are to be just decorative, then they can be attached when the frame has been completed.

The frames can be built from common components, although typically plastics are well suited for these products. The plastics may be 3D printed, injection molded or extruded.

An example of 3D printable plastics includes polylactic acid, or PLA, this material has the benefit of being biodegradable as it is manufactured using renewable raw materials such as corn starch. ABS filament another type of 3D printing thermoplastic which contains a base of elastomers based on polybutadiene, making it more flexible, and resistant to shocks. ASA is a material that has similar properties to ABS, but has a greater resistance to UV rays. Polyethylene terephthalate, or PET, is ideal for fabricating larger more rigid frames. PETG, is a glycolyzed PET polymer that combines both the simplicity of PLA 3D printing and the strength of ABS, and it is 100% recyclable. Numerous other 3D printable polymers, hybrids and composites are known and considered to be within the scope of protection sought.

Plastics that are particularly suitable for injection molding include Nylon™, acrylics, which are particularly suitable for being tinted, polycarbonate (PC), polyoxymethylene (POM), polystyrene (PS), acrylonitrile butadiene styrene (ABS), polypropylene (PP), polyethylene (PE), thermoplastic polyurethane (TPU), and thermoplastic rubber (TPR).

Plastics that are particularly suitable for extrusion include polyethylene (PE), polypropylene, acetal, acrylic, nylon (polyamides), polystyrene, polyvinyl chloride (PVC), acrylonitrile butadiene styrene (ABS) and polycarbonate.

The customizable framing system may be made from various different types of metals, or milled or precut wooden forms. The frames may also have embedded lighting, which may be powered by batteries or solar cells.

Alternative embodiments of the invention as described above mat include an integrated corner stand that allows a frame to free stand on a flat surface. The frame can be held either at 90 deg orientation or balanced on a corner. The foot or freestanding support 1402 can be any size or any shape to suit aesthetics or frame size and can include right or left-hand versions.

A center magnet member that allows the frame to be attached to the metal hanger or any metal surface. These embodiments of the invention allow hanging from ceiling and on a wall at different angles.

Stand-off extenders are also contemplated that connect to the standard hanger to allow the frame to be offset from the mounting surface. The extenders are available in different sizes.

A string or ribbon hanger is also disclosed, this hanger cooperates with the frames using the existing notch 202 on the side rails 206. This embodiment allows the frame to be hung using a string or thread, or ribbon etc. These hangers are available in single or double. The double hanger will allow back-to-back frames so pictures are visible on both sides.

Similarly, a double-sided corner is described and illustrated in FIG. 25 that allows pictures to be added to both sides. Also available with stand, foot or freestanding support 1402. Embodiments of the invention are described wherein the corners of the frames are attached to the freestanding supports 1402. In certain embodiments of the invention, the freestanding supports 1402 are formed as a unitary structure including the corner sections.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A kit for constructing an artwork frame, said kit comprising:

a plurality of corner sections, each of the corner sections having one or more first attachment members;

a plurality of corner support members, attached to each of the corner support sections via one or more second attachment members sized and proportioned to cooperate with the one or more first attachment members;

a plurality of side rails, each connecting two corner support members; and two or more display members, one or more of said two or more display members comprises an essentially planar structure that extends horizontally or vertically away from the rear of the frame, and one or more of the two or more display members are independently selected from the group consisting of: a notch;

a stand-off extender; a free-standing support; a hanging member; and a metal disc or magnet, wherein the plurality of corner sections, and the plurality of corner support members, and the plurality of side rails, define a perimeter of the artwork frame.

2. The kit of claim 1, wherein the shape of a constructed frame is selected from the group: square, rectangle, triangle, pentagon, hexagon, polygon, star, circle, diamond, rhombus, upper or lower case letters, or number.

3. The kit of claim 1, wherein one or more of the two or more display members is the notch formed centrally in one of said plurality of side rails.

4. The kit of claim 1, wherein one or more of the two or more display members comprises the attachment member, that is adapted to engage with a surface onto which the frame is to be hung, and an attachment means that is configured to connect the frame to the attachment member.

5. The kit of claim 4, wherein the attachment member is further adapted to cooperate with one or more notches formed in the plurality of side rails.

6. The kit of claim 4, wherein the attachment member comprises a magnet.

7. The kit of claim 1, wherein one or more of the two or more display members is attached to, molded as part of, or formed in, one of the plurality of corner sections.

8. The kit of claim 1, wherein the essentially planar structure supports the frame at an angle of between 60-85° on a supporting surface.

9. The kit of claim 1, wherein the essentially planar structure is attached to, molded as part of, or formed in, a curved section of one of the plurality of corner sections resulting in a lower edge of the frame being positioned in a non-parallel orientation to a supporting surface.

10. The kit of claim 1, wherein one of the two or more display members is the hanging member comprising a lip that is sized and configured to engage with one of the plurality of side rails.

11. The kit of claim 10, wherein the hanging member is further configured to engage with a notch on one of the plurality of side rails.

12. The kit of claim 1, wherein the one or more of the two or more display members is an extension member, the extension member comprising a wall attachment member, an extender and a frame connection member.

13. The kit of claim 12, wherein the frame connection member cooperates with the notch which is formed in one of the plurality of side rails.

14. The kit of claim 1, wherein one or more of said plurality of corner sections, or one or more of said plurality of corner support members forms or contains one or more embellishments.

15. The kit of claim 14, wherein the one or more embellishments are selected from the group comprising: material; foam shapes, letter, numbers or words; stickers, glitter, and gem stones.

16. The kit of claim 1, additionally comprising one or more sheets of plastic or acrylic, for cutting to an appropriate size to fit within the area formed by the frame when constructed.

17. The kit of claim 1, wherein the first attachment members are finger joints, and the second attachment members are finger joint grooves.

18. A kit for constructing an artwork frame, said kit comprising:

a plurality of corner sections, each of the corner sections having one or more first attachment members;

a plurality of corner support members, attached to each of the corner support sections via one or more second attachment members sized and proportioned to cooperate with the one or more first attachment members;

a plurality of side rails, each connecting two corner support members; and two or more display members, one of said two or more display member is a hanging member comprising a first lip that is sized and configured to engage with one of the plurality of side rails on a first frame and second lip that is sized and configured to engage with one of the plurality of side rails on a second frame, and one or more of the two or more display members independently selected from the group consisting of: a notch; a stand-off extender; a free-standing support; and a metal disc or magnet, wherein the plurality of corner sections, and the plurality of corner support members, and the plurality of side rails, define a perimeter of the artwork frame.

19. The kit of claim 18, wherein the hanging member is further configured to engage with a notch on one of the plurality of side rails of the first frame and a notch on one of the plurality of side rails of the second frame.

* * * * *